US006633319B1

(12) United States Patent
Yamakawa et al.

(10) Patent No.: US 6,633,319 B1
(45) Date of Patent: Oct. 14, 2003

(54) IMAGE RECORDING APPARATUS

(75) Inventors: Eiji Yamakawa, Sanda (JP); Hideaki Ueda, Kishiwada (JP); Kiyofumi Hashimoto, Suita (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/340,335

(22) Filed: Jun. 25, 1999

Related U.S. Application Data

(63) Continuation-in-part of application No. 09/276,354, filed on Mar. 25, 1999.

(30) Foreign Application Priority Data

| | | |
|---|---|---|
| Mar. 30, 1998 | (JP) | 10-084723 |
| Mar. 30, 1998 | (JP) | 10-084724 |
| Mar. 30, 1998 | (JP) | 10-084725 |
| Jun. 29, 1998 | (JP) | 10-182779 |

(51) Int. Cl.[7] ..... B41J 2/325

(52) U.S. Cl. ..... 347/172

(58) Field of Search ..... 347/171, 172, 347/183, 188, 185, 187; 400/120.01, 120.02, 120.07, 120.09, 695

(56) References Cited

U.S. PATENT DOCUMENTS

| | | | | |
|---|---|---|---|---|
| 3,594,126 A | | 7/1971 | Fergason et al. | 23/230 |
| 3,650,603 A | | 3/1972 | Heilmeier | 350/160 |
| 4,060,910 A | | 12/1977 | Gell, Jr. | 33/324 |
| 4,068,925 A | | 1/1978 | Tani et al. | 350/160 |
| 4,161,557 A | | 7/1979 | Suzuki et al. | 428/1 |
| 4,249,800 A | | 2/1981 | Spruijt | 350/320 |
| 4,809,019 A | * | 2/1989 | Hagunuma | 347/195 |
| 4,859,360 A | | 8/1989 | Suzuki et al. | 252/299 |

(List continued on next page.)

FOREIGN PATENT DOCUMENTS

| | | |
|---|---|---|
| JP | 49-066976 A2 | 6/1974 |
| JP | 57-079918 A | 5/1982 |
| JP | 64-075404 A | 3/1989 |
| JP | 10-321026 A | 12/1998 |
| JP | 11-024027 | 1/1999 |

OTHER PUBLICATIONS

John Henshall, *Fujix Thermo Autochrome Printers,* The Photographer, (Jan. 1996), (originally appearing as *John Henshall's Chip Shop)* http://www.epicentre.com/reports/9601cs.html, pp. 1–5.

Antonius T. M. Marcelis, ArieKoudijs and Ernst J. R. Sudholter, "Thermal and optical properties of chiral twin liquid crystalline bis (cholesteryl) alkanedioates", J. Master, Chem., 1996, 6(9), pp. 1469–1472.

O. B. Akopova and N. I. Giricheva "Synthesis and Mesomorphic and Spectral Properties of Cholesterol and Thiocholesterol Derivatives", Russian Journal of General Chemistry, vol. 67, No. 3, 1997, pp. 470–473.

"Rewritable Full–Color Recording on a Thin Solid Film of a Cholesteric Low–Molecular–Weight Compound," by Nobuyuki Tamaoki, Alexander V. Parfenov, Atsushi Masaki, and Hiro Matsuda, *Advanced Materials,* vol. 9, No. 14, 1997, pp. 1102–1104.

*Primary Examiner*—Lamson Nguyen
*Assistant Examiner*—K. Feggins
(74) *Attorney, Agent, or Firm*—Sidley Austin Brown & Wood LLP

(57) ABSTRACT

An image recording device for thermally recording monochrome and color images onto reversible heat-sensitive recording mediums such as a thermal liquid crystal compound that has a cholesteric phase. A heating device, which may include a plurality of heating elements including laser diodes, is scanned across the recording medium and the temperature of the heating element corresponding to a given picture element determines the recorded color for that picture element.

54 Claims, 12 Drawing Sheets

U.S. PATENT DOCUMENTS 5,231,505 A * 7/1993 Watanabe et al. ..... 346/21
5,244,293 A * 9/1993 Ludger ..... 400/611
5,379,058 A * 1/1995 Obu et al. ..... 347/232
5,398,050 A * 3/1995 Sato ..... 347/172
5,437,811 A 8/1995 Doane et al. ..... 252/299.01
5,593,691 A 1/1997 Eugster et al. ..... 424/461
5,699,100 A * 12/1997 Fukuda et al. ..... 347/175
5,745,153 A * 4/1998 Kessler ..... 347/241
5,909,232 A * 6/1999 Goto et al. ..... 347/187
5,929,890 A * 7/1999 Kakinuma et al. ..... 347/172
5,961,227 A * 10/1999 Kurachi ..... 400/120.09
6,103,431 A 8/2000 Tamaoki et al. ..... 430/20
6,417,915 B1 * 7/2002 Suzuki et al. ..... 355/400

* cited by examiner

IMAGE RECORDING APPARATUS

CROSS-REFERENCE TO RELATED APPLICATIONS

This Application is a Continuation-in-Part of U.S. patent application Ser. No. 09/276,354, filed Mar. 25, 1999. Additionally, this Application is based on Japanese Patent Applications No. HEI 10-182779, No. 10-84723, No. 10-84724 and No. 10-84725 filed in Japan, the contents of which are hereby incorporated by reference.

FIELD OF THE INVENTION

The present invention pertains to an image recording apparatus for recording an image onto a reversible heat-sensitive recording medium having a liquid crystal compound that exhibits a cholesteric phase.

BACKGROUND OF THE INVENTION

In light of the trend toward reduced energy consumption and environmental protection, rewritable sheets that allow overwriting of information have been developed in recent years for the purpose of paperless or reduced-paper image recording. In addition, various types of rewritable image recording materials have been developed in conjunction with the development of IC cards and prepaid cards. However, the currently available rewritable recording materials are capable only of black and white or single-color display, and a material offering full-color display capability is desired.

One rewritable compound that has a full-color display capability is known and is based on a high-molecular weight cholesteric liquid crystal compound. However, this material has not been commercialized because it has a slow response time during recording. Additionally, a second compound has been proposed that has an improved response time during recording and which is based on a low-molecular weight cholesteric liquid crystal compound. This liquid crystal compound exhibits a cholesteric phase in regions that are warmer than room temperature, and these temperature regions display a reflection color corresponding to the temperature. When these regions are cooled rapidly, the reflection color present just prior to the rapid cooling is preserved and fixed. In other words, by heating a sheet that is uniformly coated with this compound at various different temperatures and then rapidly cooling it, the display color may be freely selected and multi-color or full-color information (images) may be obtained. Moreover, by re-heating the sheet to a certain uniform temperature and cooling it, the images may be erased.

In regard to the image bearing medium, Leuco dyes with a developer and a subtractive agent, organic low molecular liquid crystal dispersed in high-molecular resin and high-molecular cholesteric liquid crystal are known as conventional rewritable thermosensible recording materials.

A Leuco dye with a developer and a subtractive agent develops a color as the lactone ring contained in the Leuco dye molecules opens, and loses the color as the lactone ring closes. The lactone ring opens when the material is rapidly cooled after being raised in temperature, and closes when the material is slowly cooled. Such a Leuco dye is coated on a sheet member, and information is written thereon with a thermal head and erased therefrom with heat rollers.

A well-known type of organic low molecular liquid crystal dispersed in high molecular resin uses BA (behenic acid) as the organic low molecular compound and uses PVCA (polyvinylchloride polyviynlacetate copolymer) as the high molecular compound. This material can be switched between a transmitting state and a scattering state in accordance with the heating temperature and can maintain the state after being cooled. Information can be written in this material with a thermal head.

High molecular cholesteric liquid crystal polymerized with a vinyl compound having a cholesteric liquid crystal compound as a side chain is known. This material can be caused to change the display color by being heated beyond a crystallization temperature and thereafter being cooled rapidly from a predetermined temperature.

Such a Leuco dye with a developer and a subtractive agent can develop only those colors determined by the Leuco dye and cannot develop full colors for a desired image. The organic low molecular liquid crystal dispersed in high-molecular resin, which displays a color by switching between the transmitting state and the scattering state, cannot develop full colors either. The high molecular cholesteric liquid crystal, in which the developed color can be changed basically in accordance with the heating temperature, requires time on the order of minutes for changing the color, which poses a large stumbling block to practical applications.

Under the circumstances, a rewritable thermosensible recording medium which a full-color image can be written on and erased from at a practicable rate is yet to be successfully developed.

In the meantime, for an overhead projector (OHP) which makes a display by projecting an image, OHP sheets which are transparent plastic films are used. On an OHP sheet, an image is recorded with a writing tool such as an oil pen or with an image forming apparatus such as a copying machine, a printer or the like.

However, such OHP sheets are expensive compared with copy sheets and are difficult to reuse. Thus, conventional OHP sheets have problems in cost and resource saving. Also, because conventional OHP sheets are transparent, the background can be seen through. Therefore, the image on an OHP sheet and the background are seen overlapped, and it may be more difficult to recognize the image on an OHP sheet than to recognize the image on a sheet of paper.

SUMMARY OF THE INVENTION

Accordingly, the object of the present invention is to provide an image recording apparatus that can efficiently write high quality images on a recording medium in which the display color changes in response to the heating temperature, and the display color is fixed by rapidly cooling the sheet down from the previous heating temperature.

In order to attain this object, the image recording apparatus pertaining to the present invention comprises a heater which selectively heats a recording medium. For the recording medium, a sheet having a recording layer comprising a low-molecular weight cholesteric liquid crystal compound is used. This liquid crystal compound has the property that its display color changes in response to the temperature to which it is heated, and the display color is fixed when it is cooled rapidly from the previous temperature. Therefore, by controlling the heating temperature of the heater, the display color may be freely selected, enabling a black and white, single-color or full-color display to be obtained. Moreover, by heating the recording layer to a certain temperature and then cooling it either rapidly or slowly, a transparent or scattered-molecule state may be selectively achieved, erasing the previously recorded information.

When performing full-color image recording, writing must be performed by changing the heating temperature of the heater while it is moved forward and backward. In this case, if only a single heating element is used for all colors, the applied voltage to the heating element must be controlled very precisely. Therefore, in the image recording apparatus pertaining to the present invention, it is preferable for the heater to have multiple heating elements having different heating temperatures located at prescribed distances from one another in the scanning directions. In other words, the multiple heating elements are controlled in a binary fashion so that each may be selectively turned ON or OFF, and where their heating temperatures are set to red, green and blue, respectively.

In a construction as described above, where image writing is performed through the scanning by multiple heating elements having different heating temperatures, if image writing is performed in a sequential fashion with the elements having the highest heating temperature going first, later there are no changes in previously written images due to subsequently written images (heating), and image quality improvement may be attained. To increase recording speed (i.e., reduce recording time), it is preferred that the heating elements be controlled so that the image may be written during both the forward and backward movement of the thermal head. When this is done, however, the heating temperature sequence must be maintained during the forward and backward movement of the thermal head. The heating temperature sequence during the forward and backward movement of the multiple heating elements may be kept constant by controlling the voltage applied to each heating element or by rotating the thermal head 180 degrees.

On the other hand, it is preferred for the image recording apparatus of the present invention to have an erasing means that erases an image which has been previously recorded on the recording medium. This enables the quality of newly-recorded images to be improved. Furthermore, if the image recording apparatus has a preliminary heating means that heats up the recording medium prior to image recording, the recording process can be made more efficient.

Another object of the present invention is to provide an improved rewritable image bearing medium.

Another object of the present invention is to provide an image bearing medium on which full-color display is possible.

Another object of the present invention is to provide an image bearing medium on which only a short time is required to make a full-color image.

Further, another object of the present invention is to provide a rewritable image bearing medium which can be used as a document for a projector such as an OHP sheet.

In order to attain the objects above, an image bearing member according to the present invention comprises a substrate and an image bearing layer disposed on the substrate. This image bearing layer contains a low molecular compound which selectively exhibits a solid phase and a thermosensible cholesteric liquid crystal phase depending on its own temperature, and the low molecular compound changes from the thermosensible cholesteric liquid crystal phase to the solid phase keeping the state set in the thermosensible cholesteric liquid crystal phase when changing its temperature rapidly.

According to the present invention, by raising the temperature of the low molecular compound in accordance with image information, a display of a desired color can be made on the image bearing member at a high speed, and further, a full-color display can be made. Also, by heating the low molecular compound again, the information displayed on the image bearing layer can be erased.

When a transparent material is used as the substrate, the image bearing medium can be used as a document for an image projector such as an OHP sheet.

Further, the image bearing medium according to the present invention may have, between the substrate and the image bearing layer, and intermediate layer which has a smooth surface in contact with the image bearing layer. The intermediate layer may be imparted with a function of absorbing at least a component of light.

Also, the image bearing medium may be a composite of a low compound and a resin material. Moreover, the image bearing layer may contain spacers to maintain the thickness of the image bearing layer.

In this specification, thermosensible cholesteric liquid crystal means a compound which has a characteristic of changing its chiral pitch as changing its temperature within a specified range. Accordingly, as thermosensible cholesteric liquid crystal changes its temperature, the wavelength of light reflected thereby changes. Further, a thermosensible cholesteric liquid crystal phase means a phase wherein thermosensible cholesteric liquid crystal exhibits the above-described characteristic.

These and other objects, advantages and features of the invention will become apparent from the following description thereof taken in conjunction with the accompanying drawings which illustrates a specific embodiment of the invention.

DETAILED DESCRIPTION OF THE PREFERRED EMBODIMENTS

Embodiments of the image recording apparatus and to the recording medium pertaining to the present invention are explained below with reference to the attached drawings.

I. Explanation of Recording Medium

Some embodiments of the recording medium of the present invention are described hereafter with reference to the accompanying drawings. The embodiments are described by citing specific names of materials. These materials, however, are merely examples and should be construed as limitations on the invention as it will be apparent to one of ordinary skill in the art that various other materials can be used.

First Embodiment

Figure 1:
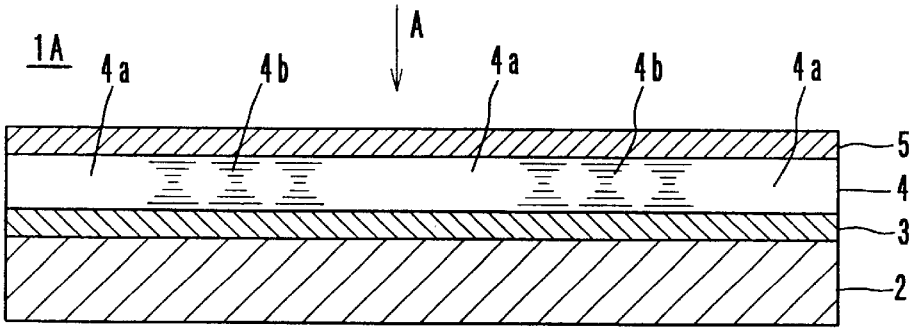
FIG. 1 is a sectional view of a recording medium as the first embodiment of the present invention.

In FIG. 1, a rewritable thermosensible recording medium 1A comprises a base layer 2, an intermediate layer 3, a recording layer 4 and a protective layer 5. The base layer 2 is a sheet of a flexible material such as paper, polycarbonate or PET (polyethylene terephthalate). A white PET film is used in the first embodiment. The use of flexible sheets has the advantage of being capable of being bent and bound like paper.

The intermediate layer 3 contains a component having a function of absorbing visible light and the surface which is in contact with the recording layer 4 is smoother than the surface of the base layer 2. Specifically, carbon black was dispersed in silicon resin (YR3370 made by Toshiba Silicone), and this was dissolved in an isopropyl alcohol solution mixed with a catalyst (CR15 made by Toshiba Silicone). The resulting solution was coated on the base layer 2 and was thermally set by being dried to have a thickness of 5 $\mu$m.

The recording layer 4 is a liquid crystal layer containing a low molecular cholesteric liquid crystal compound. Specifically, toluene and 10, 12-dicholesteryl docosadiindionate which is a liquid crystal compound of the following chemical formula (A) were mixed and dissolved with each other at a ratio by weight of 100 to 10. This solution was coated by a blade on the intermediate layer 3 and was heated and dried to be made into a rewritable thermosensible recording layer 4 with a thickness of 10 $\mu$m. The desirable thickness of the recording layer 4 is within a range from 3 $\mu$m to 50 $\mu$m, and preferably, within a range from 6 $\mu$m to 20 $\mu$m.

(A)

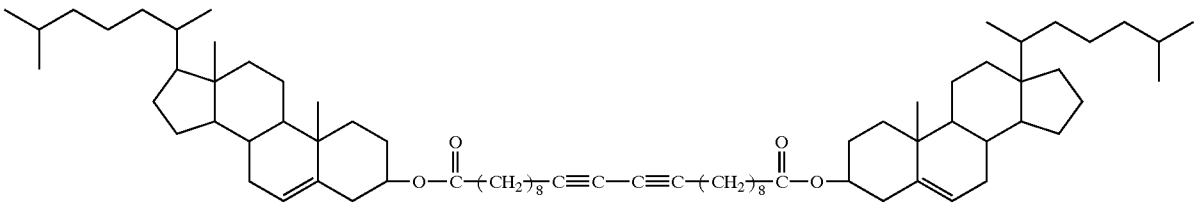

The protective layer 5 is made of a resin material.

Specifically, a polyester film with a thickness of 3 $\mu$m was laid on the recording layer 4. Both were attached to each other by being heated at 100° C., and the edges were sealed with an adhesive (Alonalfar made by Toagosei Co., Ltd.).

When the recording medium 1A composed of the materials described above is heated to 87 to 115° C., the cholesteric liquid crystal compound exhibits a cholesteric phase in which the helical axis is oriented in a direction perpendicular to the intermediate layer 3, and the cholesteric liquid crystal compound reflects light of a specific wavelength depending on the temperature. The cholesteric liquid crystal compound reflects red at approximately 87° C., reflects green at approximately 95° C. and reflects blue at approximately 115° C. When rapidly cooled from these temperatures, the recording medium 1A is solidified while remaining in the reflective state.

When rapidly cooled after being heated to approximately 119° C. or higher, the recording layer 4 becomes transparent. Specifically, when the recording medium 1A is rapidly cooled after being heated to 119° C. or higher° by heat rollers or the like, the recording layer 4 becomes transparent in its entirety. In this state, visible light is absorbed by the intermediate layer 3. The recording layer 4, therefore, appears black to the observer viewing from the direction indicated by arrow "A".

When this recording medium 1A is partially heated and rapidly cooled using a conventionally-known thermal head, the heated portion develops a reflection color corresponding to the heating temperature. In FIG. 1, reference numeral 4*a* denotes transparent portions, and numeral 4*b* denotes portions remaining in the cholesteric phase. When information is written at 95° C. by a thermal head, therefore, a green display on a black background can be viewed from the direction of arrow "A". When the writing is performed at 87° C., 95° C. and 115° C., a red display, a green display and a blue display can be viewed, and thus a full-color display is possible. According to the first embodiment, in order to make a low-reflectance display, for example, in order to make a display of dark blue partly, minuscule blue portions and minuscule black portions are arranged in mosaic in that part. Thereby, the part can be viewed as dark blue macroscopically.

In the recording medium 1A, the display color developed by the liquid crystal is observed on a black background. In the case where a coloring agent for reflecting visible light in a specific wavelength range is added to the intermediate layer 3, the display color developed by the liquid crystal is observed on a background of a single color depending on the coloring agent. For display on a white background, for example, minuscule portions of blue, green and red are arranged in mosaic in areas with no image information. Thus, white can be viewed in the areas macroscopically, thereby realizing a white background.

According to the first embodiment, the melting point of the base layer 2 is not lower than 200° C., the melting point of the intermediate layer 3 is not lower than 200° C., the crystallization temperature of the protective layer 5 is 200° C., and the melting point of the recording layer 4 is 119° C. Even when the recording layer 4 is liquefied by being heated to 119° C. or higher at the time of writing or erasing, as long as the base layer 2, the intermediate layer 3 and the protective layer 5 are kept at a temperature not higher than the melting points thereof, respectively, the mechanical strength of the layers 2, 3 and 4 can be maintained, and the thickness of the recording layer 4 can be held against the pressure exerted by the thermal head. If spherical spacers are mixed in the recording layer 4, the thickness of the recording layer 4 can be maintained more positively.

Second Embodiment

Figure 2:
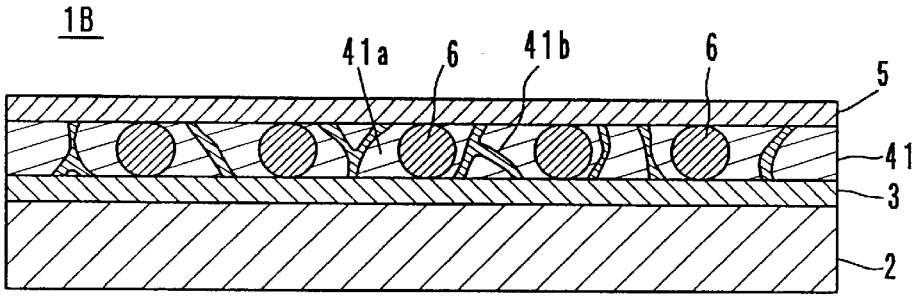
FIG. 2 is a sectional view of a recording medium as the second embodiment of the present invention.

In FIG. 2, a rewritable thermosensible recording medium 1B comprises a base layer 2, an intermediate layer 3, a recording layer 41 and a protective layer 5. The layers other than the recording layer 41 are identical to the corresponding layers of the first embodiment. The recording layer 41 is a composite of a low molecular cholesteric liquid crystal compound and a high polymer resin. The low molecular liquid crystal compound is separated into liquid crystal sections 41*a* by the resin layer 41*b*. Further, spherical spacers 6 of resin or an inorganic oxide are mixed in the recording layer 41.

According to the second embodiment, in which a high-polymer composite layer is used for the recording layer 41, the mechanical strength of the recording layer 41 is so high that the damage under an external force such as friction can be minimized. Also, the recording layer 41 is not deteriorated even when the low molecular cholesteric liquid crystal compound is heated to a temperature at which it assumes an isotropic phase.

Now, specific examples of the materials and the method of fabrication will be explained below.

First Example of the Second Embodiment

Phthalocyanine pigment was dispersed in silicon resin (YR3370 made by Toshiba Silicone), and this was dissolved in an isopropyl alcohol solution mixed with a catalyst (CR15 made by Toshiba Silicone). The resulting solution was coated on a transparent PET (polyethylene terephthalate) film and was dried and thermally set to be made into a blue intermediate layer 3 with a thickness of 5 μm. Silica spacers 6 having an average particle size of 15 μm were dispersed in ethanol and sprayed on the intermediate layer 3.

Then, the cholesteric liquid crystal compound of the chemical formula (A) and bifunctional acrylate R712 (made by Nippon Kayaku Co., Ltd.) with an aromatic ring containing a photopolymerization initiator DAROCUR1173 (made by Chiba-Geigy (Japan)) at 3 wt % were mixed with each other at a ratio by weight of 8 to 2, and thus, a liquid crystal mixture was prepared. This liquid crystal mixture was coated on the intermediate layer 3, and a transparent polyether sulfonic film with a thickness of 2 μm was superposed thereon as a protective layer 5.

Next, while the protective layer 5 was pressed, ultraviolet rays of 0.02 mW/cm$^2$ were radiated for one hour. Thus, a composite layer (recording layer 41) with a thickness of 15 μm was formed.

Second Example of the Second Embodiment

A polyimide solution (made by Sumitomo Bakelite Co., Ltd.) was coated on a white PES (polyether sulfone) film and was dried and thermally set to be made into an intermediate layer 3 with a thickness of 1 μm. Silica spacers 6 having an average particle size of 15 μm were dispersed in ethanol and sprayed on the intermediate layer 3.

Then, the liquid crystal mixture having the composition described in the first example was coated on the intermediate layer 3, and a transparent PET (polyethylene tetephthalate) film with a thickness of 2 μm was superposed thereon as a protective layer 5.

Then, while the protective layer 5 was pressed, ultraviolet rays of 15 mW/cm$^2$ were radiated for five minutes. Thus, a composite layer (recording layer 41) with a thickness of 15 μm was formed.

Third Embodiment

Figure 3:
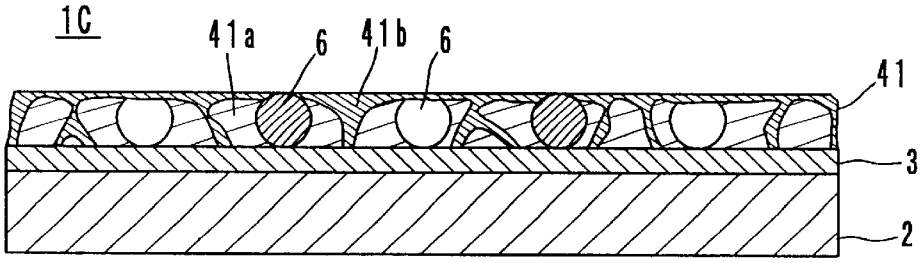
FIG. 3 is a sectional view of a recording medium as the third embodiment of the present invention.

In a rewritable thermosensible recording medium 1C according to the third embodiment shown in FIG. 3, the protective layer 5 of the recording medium 1B shown in FIG. 2 is omitted. Therefore, the fabrication process thereof is simplified, and the production cost can be reduced. Even in the absence of the protective layer 5, the resin layer 41*b* formed on the surface of the recording layer 41 functions as a protective layer. Therefore, the recording layer 41 has a sufficient mechanical strength, and damage due to an external force such as bend or friction can be minimized. Also, the low molecular cholesteric liquid crystal compound, even if heated to the temperature at which it assumes an isotropic phase, is not much deteriorated.

Specific examples of the materials and the fabrication method will be described below.

First Example of the Third Embodiment

Polyvinyl alcohol was dissolved in water at a ratio by weight of 1 to 31, and carbon black was dispersed in the resulting solution at a ratio by weight of 1 to 32. The solution thus obtained was coated on white synthetic paper to be made into an intermediate layer 3 with a thickness of 1.5 μm. Silica spacers 6 having an average particle size of 15 μm were dispersed in ethanol and sprayed on the intermediate layer 3.

Then, the liquid crystal mixture having the composition described in the second embodiment was coated on the intermediate layer 3, and ultraviolet rays of 15 mW/cm$^2$ were radiated for five minutes. Thus, a composite film (recording layer 41) with a thickness of 15 μm was formed.

Second Example of the Third Embodiment

The same intermediate layer 3 as in the first example was formed on quality paper, and further, silica spacers 6 having an average particle size of 15 μm were dispersed in ethanol and sprayed thereon. Then, the liquid crystal mixture used in the first example was coated on the intermediate layer 3. Thereafter, ultraviolet rays of 0.02 mW/cm$^2$ were radiated for one hour, and further, ultraviolet rays of 0.25 mW/cm$^2$ were radiated for another hour. Thus, a composite layer (recording layer 41) with a thickness of 20 μm was formed.

Fourth Embodiment

Figure 4:
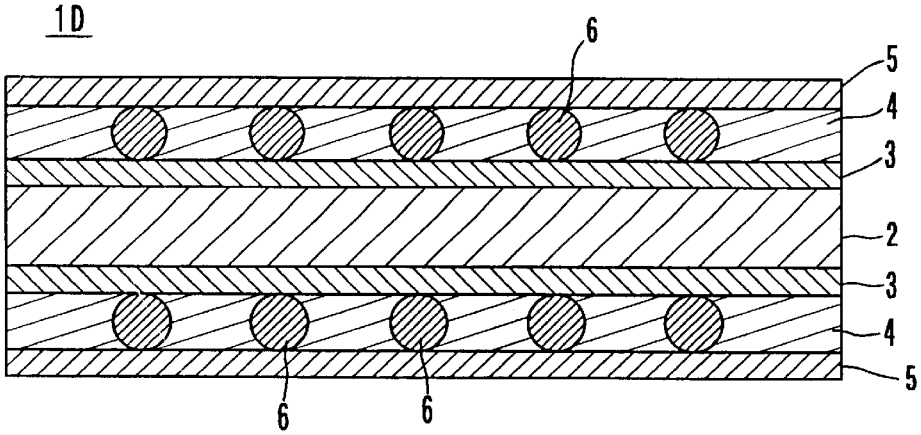
FIG. 4 is a sectional view of a recording medium as it the fourth embodiment of the present invention.

A rewritable thermosensible recording medium 1D according to the fourth embodiment shown in FIG. 4 is so constructed that the intermediate layer 3, the recording layer 4 and the protective layer 5 are formed on the front and back surfaces of the base layer 2. Information can be displayed on both surfaces of this recording medium 1D.

Specifically, aluminum with a thickness of about 600 Å was provided as an intermediate layer 3 for reflecting light on both sides of a transparent PES (polyether sulfone) film with a thickness of 200 μm. The liquid crystal compound of the chemical formula (A) and toluene were mixed and dissolved with each other at a ratio by weight of 10 to 100, and silica spacers 6 having an average particle size of 15 μm were mixed in this solution. The resulting solution was coated by a blade on the intermediate layer 3 and was heated and dried to be made into a rewritable thermosensible recording layer 4 with a thickness of 20 μm. Further, a polyester film with a thickness of 5 μm was laid on the recording layer 4 and attached thereto by being heated at 100° C.

Fifth Embodiment

Figure 5:
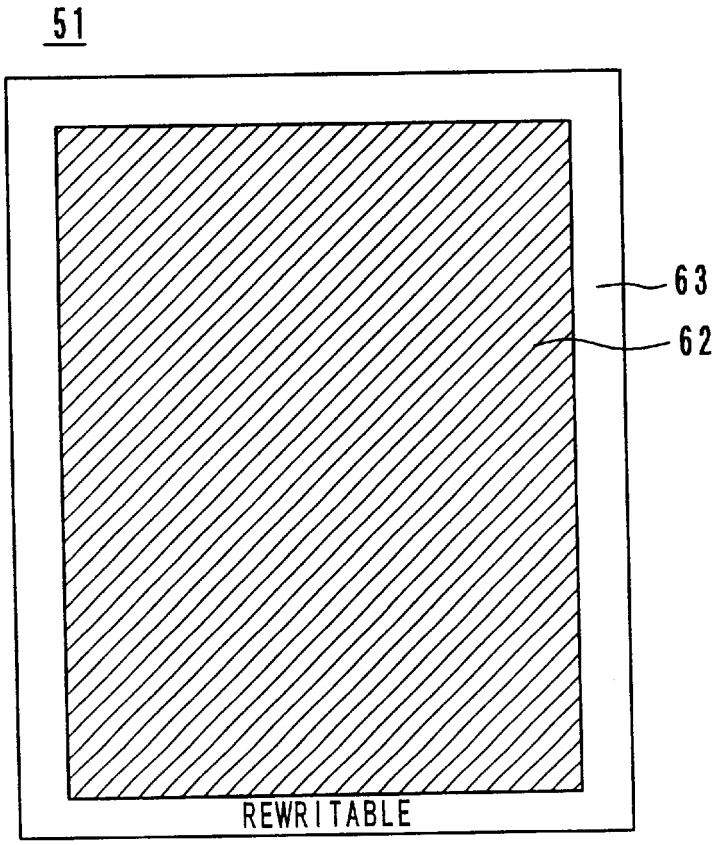
FIG. 5 is a plan view of a recording medium as the fifth embodiment of the present invention.

A rewritable thermal recording medium 51 according to the fifth embodiment shown in FIG. 5 has a central light absorbing area 62 shown as a shadowed portion and a light scattering area 63 along the periphery thereof. According to the first to fourth embodiments described above the intermediate layer 3 with a light absorbing function is formed over the entire surface of each of the recording media 1A through 1D. In the fifth embodiment, the light scattering area 63 is arranged along the periphery. Each of the recording media 1A through 1D described in the first to fourth embodiments is initialized to a black display in its entirety by being heated through heat rollers. In the presence of a marginal area of the printer where writing is impossible, however, the peripheral portion is left black after an image is written in the recording medium. Accordingly, in the case of making a display on a colored background or on a white background, the display becomes unnatural as compared with an image written on paper in a method of prior art. In the recording medium 51 according to the fifth embodiment, the area corresponding to the margin of the printer constitutes the light scattering area 63, whereby a natural display with a white peripheral portion becomes possible. Each side of the light scattering area 63 as the margin is several millimeters to two centimeters wide, and preferably, one centimeter to two centimeters.

Figure 6:
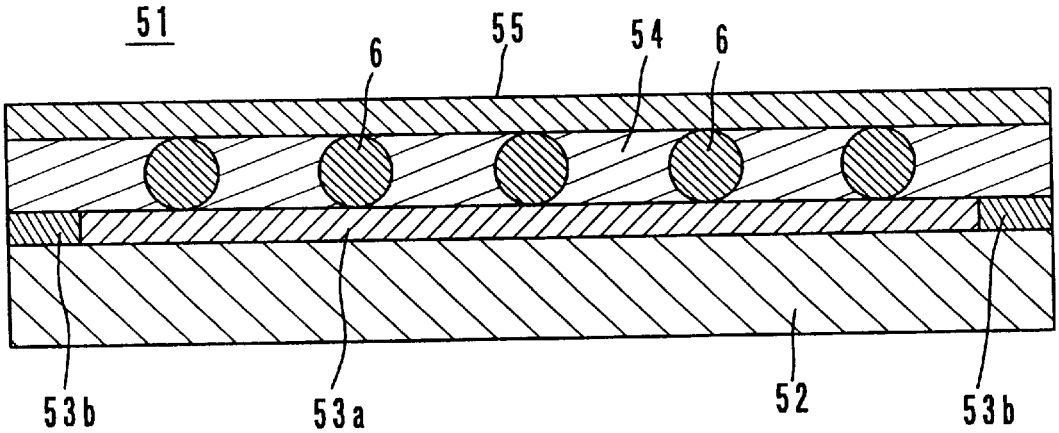
FIG. 6 is a sectional view of the recording medium shown by FIG. 5.

FIG. 6 is a sectional view of the recording medium 51 comprising a base layer 52, intermediate layers 53*a* and 53*b*, a recording layer 54 having spacers 6, and a protective layer 55. The intermediate layer 53*a* is formed in a portion corresponding to the light absorbing area 62 and has a light-absorbing function. The intermediate layer 53*b*, on the other hand, is formed in a portion corresponding to the light scattering area 63 and is made of a light-transmitting material. When paper is used as the base layer 52, use of a transparent material as the intermediate layer 53*b* imparts a light scattering characteristic to the peripheral portion. In the case where a transparent material is used as the base layer 52, on the other hand, it is possible to impart a light scattering characteristic to the peripheral portion by dispersing titanium oxide particles or the like in the area of the intermediate layer 53*b*.

In FIG. 5, the character "REWRITABLE" under the recording medium 51 is preprinted in the light scattering area 63 and indicates that this recording medium 51 is a rewritable thermosensible recording medium. Of course, the name of a company or a decoration pattern can be printed as well as the character.

A specific example of the materials and the fabrication method will be described below.

An isopropyl alcohol solution with carbon black dispersed in a copolymer nylon resin (CM8000 made by Toray Industries, Inc.) was coated as the intermediate layer 53*a* on quality paper and dried to have a thickness of 5 μm. Also, an isopropyl alcohol solution with titanium oxide dispersed in the same copolymer nylon resin was coated on the quality paper as the intermediate layer 53*b* and dried to have a thickness of 5 μm.

Then, the liquid crystal compound of the chemical formula (A) and toluene were mixed and dissolved with each other at a ratio by weight of 10 to 100, and silica spacers 6 having an average particle size of 15 μm were mixed in this solution. The resulting solution was coated by a blade on the intermediate layer 53*a* and was heated and dried to be made into a rewritable thermosensible recording layer 54 with a thickness of 20 μm. Further, an ultraviolet-setting resin (Unidic C7-157 made by Dainippon Ink & Chemicals, Inc.) containing urethane acrylate as the main component was diluted by ethyl acetate at a ratio by weight of 100 to 50, and the resulting solution was coated on the recording layer 54. Then, ultraviolet rays of 15 mW/cm$^2$ were radiated for five minutes. Thus, a protective layer 55 with a thickness of 4 μm was formed.

Sixth Embodiment

According to the sixth embodiment, though not specifically shown, an infrared absorbent is dispersed in the intermediate layers 3 and 53*a* and/or the protective layers 5 and 55 of the first to fifth embodiments to provide a function of converting infrared light into heat. As an alternative, the intermediate layers 3 and 53*a* and/or the protective layers 5 and 55 themselves can be formed of a material capable of absorbing infrared light. Imparting a function of absorbing infrared light to the neighborhood of the recording layers 4 and 54 in this way enables a laser printer to write information therein efficiently.

Seventh Embodiment

Figure 7A:
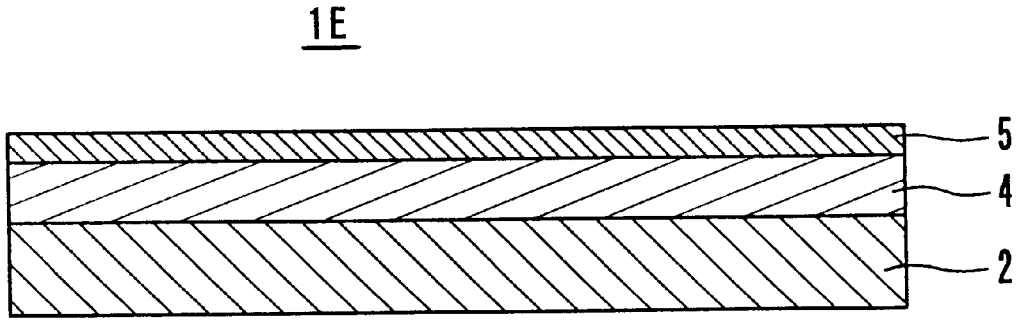
FIGS. 7*a* and 7*b* are sectional views of a recording medium as the seventh embodiment of the present invention.
Figure 7B:
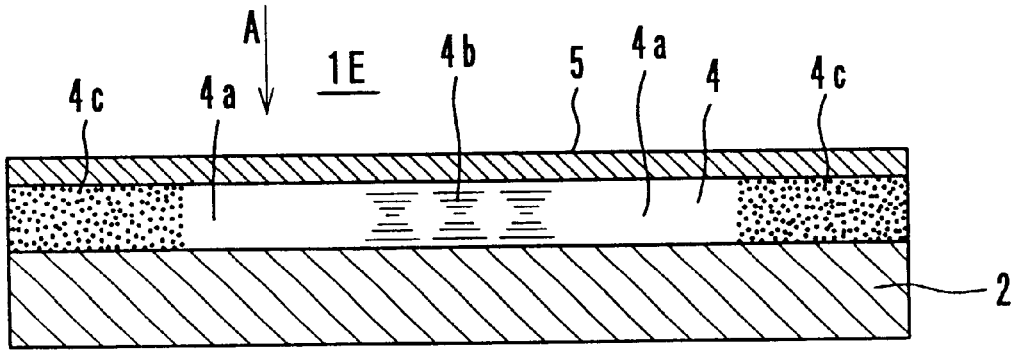

As FIGS. 7*a* and 7*b* show, a rewritable thermosensible recording medium 1E according to the seventh embodiment comprises a base layer 2, a recording medium 4 and a protective layer 5. The base layer 2 is a transparent plastic film. The recording layer 4 contains an organic low molecular cholesteric liquid crystal compound. This liquid crystal compound, when it is heated from a room temperature to a high temperature and thereafter cooled rapidly, transmits visible light at least within a certain wavelength range. Specifically, when the liquid crystal compound is heated to a temperature over the phase transition temperature and thereafter cooled rapidly, it becomes transparent. When it is heated to a temperature over the room temperature and under the phase transition temperature, it reflects visible light within a wavelength range, which depends on the heated temperature, and transmits visible light out of the wavelength range. Then, when the liquid crystal compound is cooled rapidly from the temperature, it is solidified with the reflection state maintained. Also, when the liquid crystal compound is heated over the room temperature and thereafter cooled slowly, it scatters light. Out of such low molecular cholesteric liquid crystal compounds, 10, 12-dicholesteril docosadiindionate of the chemical formula (A) is the most suited to be used for such a rewritable thermosensible recording layer 4. The thickness of the recording layer 4 is desirably within a range from 3 μm to 50 μm, and preferably within a range from 6 μm to 20 μm.

Because this recording medium 1E has the recording layer 4 containing the liquid crystal compound of the chemical formula (A), when it is heated to a temperature within a range from 87° C. to 115° C., it exhibits a cholesteric phase wherein the herical axis of the cholesteric liquid crystal compound is oriented in a direction perpendicular to the base layer 2 and reflects light with a specified wavelength according to the temperature. Specifically, when the recording medium 1E is heated to approximately 87° C., the recording layer 4 shows red; when heated to approximately 95° C., the recording layer 4 shows green; when heated to approximately 115° C., the recording layer 4 shows blue; and when heated to approximately 120° C., the recording layer 4 becomes transparent. Then, when the recording medium 1E is cooled from these temperatures rapidly, the recording layer 4 is solidified with the respective reflection states maintained.

Also, when the recording medium 1E is heated over a liquid crystal phase temperature (which means a, temperature at which the recording layer 4 starts exhibiting a liquid crystal phase) and thereafter cooled slowly, the recording layer 4 comes to a scattering state and becomes translucent. Specifically, when the recording layer 4 is heated to 85° C. or higher by use of heat rollers or the like and thereafter cooled slowly, the entire surface of the recording layer 4 comes to a scattering state. If the recording medium 1E is used as an OHP film, when light coming from the direction of arrow "A" is projected, the recording layer 4 in this scattering state is seen as a dark color. In order to erase an image which has been recorded in the previous writing operation, it is preferred to heat the recording layer 4 over the phase transition temperature at which the recording layer 4 comes to an isotropic phase and thereafter cool the recording layer 4 slowly.

When the recording medium 1E is partly heated by use of a thermal head which generates heat in accordance with image information and thereafter cooled rapidly, the heated part shows a reflected color which depends on the temperature. In FIG. 7*b*, the reference symbol 4*a* denotes the heated reflection part. For example, writing by use of a thermal head is performed at a temperature of 95° C. so that the recording layer 4 will reflect light of green, and light coming from the direction of arrow "A" is projected on the recording medium 1E which is used as an OHP film. In this case, a display of light red which is a complementary color of green can be observed on a dark background.

The reference symbol 4*b* denotes a part which becomes transparent by being heated to a temperature of 119° C. or higher and thereafter cooled rapidly. Viewing from the side of "A", this part 4*b* is seen as a bright color. The part denoted by the reference symbol 4*c* is a scattering part which was cooled slowly after being heated, and this part is a marginal part wherein writing by use of a thermal head is not performed. Also, when writing is performed at 87° C., 95° C., 115° C. and not lower than 119° C., displays of the respective colors can be obtained.

In the seventh embodiment, both the melting point of the base layer 2 and that of the protective layer 5 are not lower than 200° C., and the phase transition temperature at which the liquid crystal compound contained in the recording layer 4 changes from a liquid crystal phase to an isotropic phase is 119° C. Therefore, even if the recording layer 4 is liquefied by being heated to 119° C. or higher in writing or erasing operation, as long as the base layer 2 and the protective layer 5 are kept at a temperature under their melting points, the mechanical strength of the layers 2 and 5 can be maintained, and the thickness of the recording layer 4 can be maintained even with pressure applied from the thermal head. Further, by mixing spherical spacers in the recording layer 4, the thickness of the layer 4 can be maintained more positively. Also, in the eighth embodiment described below, the melting point of an intermediate layer 3 is not lower than 200° C.

Now, specific examples of the composition and the fabrication method of the rewritable thermosensible recording medium are shown.

First Example of the Seventh Embodiment

The liquid crystal compound of the chemical formula (A) was mixed and dissolved with dichloroethane at a ratio by weight of 10 to 100. This solution was coated by a blade on a transparent polyester film with a thickness of 100 μm and was heated and dried to be made into a rewritable thermosensible recording layer 4 with a thickness of 10 μm. Further, a polyester film with a thickness of 5 μm was laid on the recording layer 4 and joined thereto by being heated to 100° C. Then, this was cooled slowly, whereby the recording layer 4 came to a translucent scattering state.

In this example, a part where writing by use of a thermal head was performed at 98° C. became green. In other words, a green display was seen on a white background. When this was projected by use of an overhead projector, the translucent scattering portion was seen as a dark color, and the green display became light red.

Accordingly, a light red image with a good contrast to a dark background could be obtained. Also, when writing at 119° C. was performed in a part of the recording medium, the part was seen as another color different from the color of the part where writing at 98° C. was performed. When the recording medium was heated to 120° C. by heat rollers and thereafter cooled slowly, the entire surface of the recording layer 4 came to a translucent scattering state.

Second Example of the Seventh Embodiment

Dichloroethane, the liquid crystal compound of the chemical formula (A) and silica spacers with a diameter of 10 μm were mixed and dissolved with each other at a ratio by weight of 100:10:0.1. This solution was coated by a blade on a transparent polyester film with a thickness of 100 μm and was heated and dried to be made into a recording layer 4 with a thickness of 10 μm. Further, a polyester film with a thickness of 5 μm was laid on the recording layer 4 and joined thereto by being heated to 100° C. Then, this was cooled slowly, whereby the recording layer 4 came to a translucent scattering state.

In the second example, a part where writing by use of a thermal head was performed at 120° C. became transparent. Accordingly, when this recording medium was laid on a surface of a specified color, a display of the color was seen on a white background. For example, when the recording medium was laid on a black surface, a black display was seen on a white background. When this was projected by use of an overhead projector, the translucent scattering part became dark color, and a bright image with a good contrast to a dark background could be obtained. On the other hand, when writing was performed at 120° C. in an area with no image information (in a background) on the recording medium, the written area became transparent, and the other portions (corresponding to portions with image information) were kept in the translucent scattering state. Thereby, a white image on a transparent background could be obtained. When this was projected by use of an overhead projector, the translucent scattering part became dark color, and an image of a dark color with a good contrast to the background of the color of the light source could be obtained. After the image writing described above, when the recording medium 1E passed between heat rollers which were heated to 120° C. and thereafter was cooled slowly, the entire surface of the recording medium 1E came to a translucent scattering state.

Third Example of the Seventh Embodiment

The cholesteric liquid crystal compound of the chemical formula (A) and bifunctional acrylate R712 (made by Nippon Kayaku Co., Ltd.) with an aromatic ring containing a photopolymeraization initiator DAROCUR1173 (made by Chiba-Geigy (Japan)) at 3 wt % were mixed with each other at a ratio by weight of 8 to 2. Thereby, a liquid crystal mixture was prepared, and this liquid crystal mixture was coated on a yellow polyimide film. Ultraviolet rays of 0.02 $MW/cm^2$ were radiated for one hour, and further ultraviolet rays of 0.25 $mW/cm^2$ were radiated for another hour. In this way, a composite layer (rewritable thermosensible recording layer 4) with a thickness of 15 $\mu$m was formed.

In the third example, a part of the recording layer 4 where writing by use of a thermal head was performed at 120° C. became transparent, and because of the base layer 2, the part was seen as yellow. The other parts were left in a translucent scattering state. Thus, a yellow display was seen on a white background. When this was projected by use of an overhead projector, the translucent scattering part became a dark color, and a yellow image with a good contrast to the background of the dark color could be obtained. On the other hand, when writing was performed at 120° C. in an area with no image information (background), the written area became transparent, and the other parts (parts with image information) were left in a translucent scattering state. Thus, a white image could be obtained on a transparent background. When this was projected by use of an overhead projector, the translucent scattering part became a dark color, and an image of the color of the light source with a good contrast to the dark background could be obtained. After the image writing described above, when the recording medium passed between heat rollers which were heated to 120° C. and thereafter was cooled slowly, the entire surface of the recording layer 4 came to a translucent scattering state.

Eighth Embodiment

Figure 8:
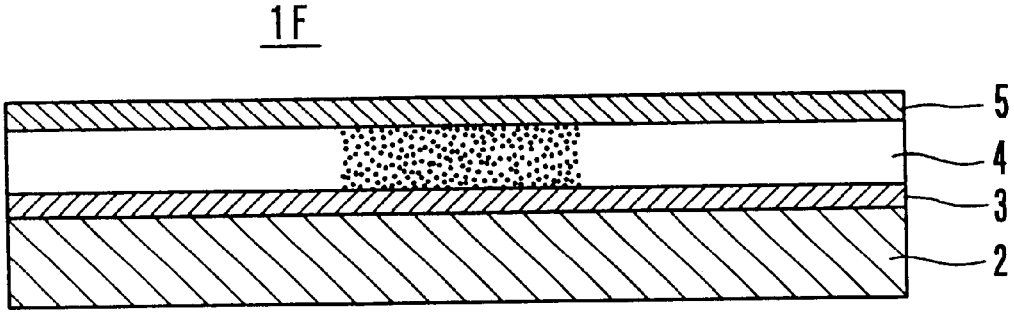
FIG. 8 is a sectional view of a recording medium as the eighth embodiment of the present invention.

As FIG. 8 shows, a rewritable thermosensible recording medium 1F comprises a base layer 2, an intermediate layer 3, a recording layer 4 and a protective layer 5. The intermediate layer 3 contains a component which absorbs visible light in a specified wavelength range. Writing and easing of information on and from the recording layer 4 are the same as in the seventh embodiment.

Specific examples of the materials and the fabrication method of the rewritable thermosensible recording medium of the eighth embodiment are given below.

First Example of the Eighth Embodiment

Phthalocyanine pigment, which serves as a light absorbent, was mixed with silicone resin (YR3370 made by Toshiba Silicone), and further, this was dissolved in an isopropyl alcohol solution mixed with a catalyst (CR15 made by Toshiba Silicone). This solution was coated on a polyether sulfone film and was dried and set to be made into a blue intermediate layer 3 with a thickness of 5 $\mu$m. Silica spacers with an average particle size of 15 $\mu$m were dispersed in ethanol and sprayed on the intermediate layer 3.

The cholesteric liquid crystal compound of the chemical formula (A) and bifunctional acrylate R712 (made by Nippon Kayaku Co., Ltd.) with an aromatic ring containing a photopolymerization initiator DAROCUR1173 (made by Chiba-Geigy (Japan)) at 3 wt % were mixed with each other at a ratio by weight of 8 to 2. Thereby, a liquid crystal mixture was prepared. This liquid crystal mixture was coated on the intermediate layer 3, and further, a transparent film with a thickness of 2 $\mu$m was laid thereon as a protective layer 5.

Next, while the protective layer 5 was pressed, ultraviolet rays of 0.02 $mW/cm^2$ were radiated for one hour, and further ultraviolet rays of 0.25 $mW/cm^2$ were radiated for another hour. In this way, a rewritable thermosensible recording layer 4 with a thickness of 15 $\mu$m was formed.

In this first example, a part of the recording layer 4 where writing by use of a thermal head was performed at 120° C. became transparent, and because of the base layer 2, this part became blue. The other parts were left in a translucent scattering state. Thus, a blue display was seen on a white background. When this was projected by use of an overhead projector, the part in a translucent scattering state was seen as a dark color, and a blue image with a good contrast to the dark background could be obtained. When the recording medium was cooled slowly after passing between heat rollers which were heated to 120° C., the entire surface of the recording layer 4 came to a translucent scattering state.

Second Example of the Eighth Embodiment

On a transparent polyether sulfone film with a thickness of 100 $\mu$m, an orientation film of polyimide with a thickness of 1 $\mu$m was coated as the intermediate layer 3. Next, the liquid crystal compound of the chemical formula (A) and toluene were mixed and dissolved with each other at a ratio by weight of 10 to 100, and this solution was coated by a blade on the intermediate layer 3 and was heated and dried to be made into a rewritable thermosensible recording layer 4 with a thickness of 12 $\mu$m. Further, a polyester film with a thickness of 5 $\mu$m was laid on the recording layer 4 and was joined thereto by being heated to 100° C. Thereafter, when this was cooled slowly, the recording layer 4 came to a translucent scattering state.

In the second example, a part of the recording layer 4 where writing by use of a thermal head was performed at 120° C. became transparent. Accordingly, is when this recording medium 1F was mounted on a surface of a specified color (for example, on a black surface), a display of the color (a black display in the case of black surface) was seen on a white background. When this was projected by use of an overhead projector, the part in a translucent scattering state was seen as a dark color, and an image with a good contrast to the dark background could be obtained.

Thereafter, when this recording medium passed between heat rollers which were heated to 120° C. and thereafter was cooled slowly, the entire surface of the recording layer 4 came to a translucent scattering state.

Ninth Embodiment

It is possible to impart a function of absorbing infrared rays to the intermediate layer 3 and/or the protective layer 5 of the eighth embodiment shown by FIG. 8 by dispersing a near infrared light absorbent in the layer 3 and/or the layer 5 or by making the layer 3 and/or the layer 5 of a near infrared light absorbing material. In the ninth embodiment, though not shown, a part near the recording layer 4 has an infrared light absorbing function. Thereby, effective writing on the recording medium of the ninth embodiment by use of a laser printer becomes possible.

Tenth Embodiment

Figure 9A:
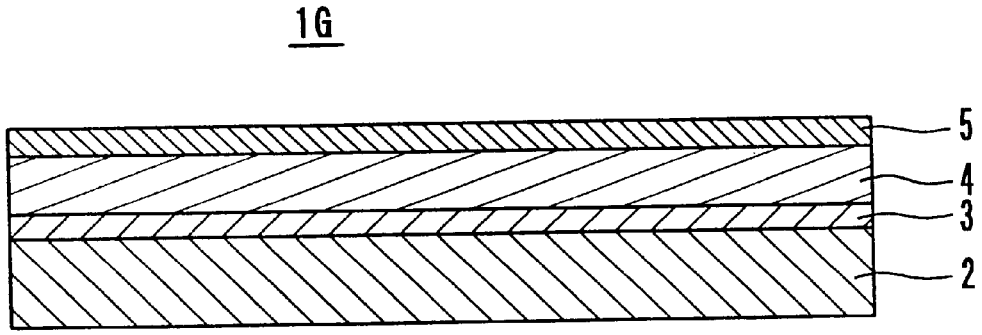
FIGS. 9*a* and 9*b* are sectional views of a recording medium as the tenth embodiment of the present invention.
Figure 9B:
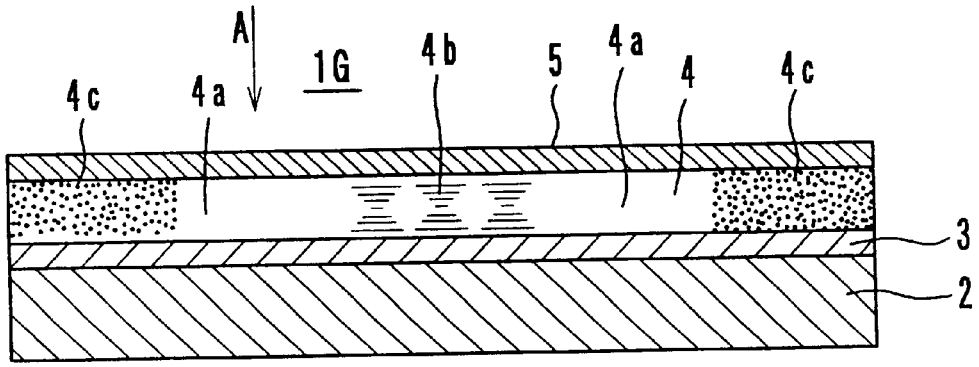
Figure 10:
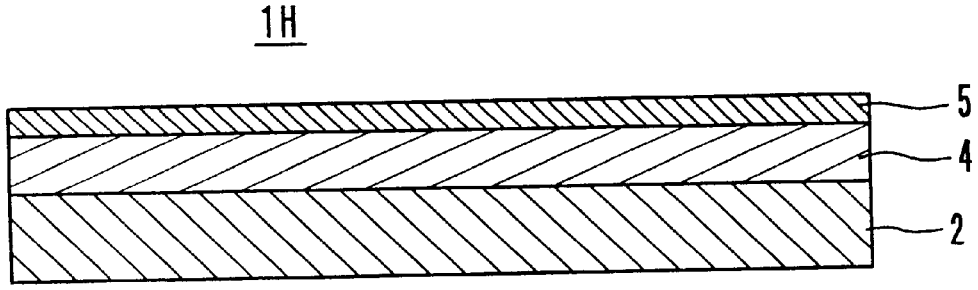
FIG. 10 is a sectional view of a recording medium as the eleventh embodiment of the present invention.

As FIGS. 9*a* and 9*b* show, a rewritable thermosensible recording medium 1G comprises a base layer 2, an intermediate layer 3, a recording layer 4 and a protective layer 5. The base layer 2 is a sheet of a flexible material such as paper, polycarbonate, PET (polyethylene terephthalate) or the like. The use of flexible sheets has the advantage of being handled like paper, and specifically, of being bent and bound. The intermediate layer 3 contains a component which has a function of absorbing visible light, and the surface which is in contact with the recording layer 4 is smoother than the surface of the base layer 2.

If the intermediate layer 3 is colored and translucent, the base layer 2 preferably has a characteristic of absorbing light or absorbs light in cooperation with the intermediate layer 3 so that a quality full-color image can be reproduced. It is possible to make the intermediate layer 3 of a transparent material. In this case, it is preferred that the base layer 2 has a function of absorbing light.

The recording layer 4 contains an organic low molecular cholesteric liquid crystal compound. This liquid crystal compound, when it is under a temperature higher than the room temperature, is in a cholesteric phase and reflects light within a certain wavelength range depending on the temperature. Then, when the liquid crystal compound is cooled from the temperature rapidly, it is solidified with the reflection state maintained. Moreover, the liquid crystal compound comes to an isotropic phase when it is heated higher, and when it is cooled slowly from the temperature where it is in a cholesteric phase or the temperature wherein it is in an isotropic phase, it comes to a scattering state. Out of such low molecular cholesteric liquid crystal compounds, 10, 12-dicholesteril docosadiindionate of the chemical formula (A) is the most suited to be used for the recording layer 4. The thickness of the recording layer 4 is desirably within a range from 3 $\mu$m to 5 $\mu$m, and preferably within a range from 6 $\mu$m to 20 $\mu$m.

Since the recording layer 4 of the recording medium 1G contains the liquid crystal compound of the chemical formula (A), when the recording medium 1G is heated to a temperature within a range from 87° C. to 115° C., the recording layer 4 comes to a cholesteric phase wherein the herical axis is oriented in a direction perpendicular to the base layer 2 and reflects light of a specified wavelength depending on the temperature. When it is heated to approximately 87° C., the recording layer 4 is seen as red; when heated to approximately 95° C., the recording layer 4 is seen as green; and when heated to approximately 115° C., the recording layer 4 is seen as blue. Then, when the recording medium 1G is cooled rapidly from these temperatures, the recording layer 4 is solidified with the respective reflection states maintained.

Also, when the recording medium 1G is heated to 119° C. or higher, the recording layer 4 comes to an isotropic phase. Thereafter, when the recording medium 1G is cooled rapidly, the recording layer 4 becomes transparent, and when the recording medium 1G is cooled slowly, the recording layer 4 becomes translucent and comes to a scattering state. Specifically, when the recording medium 1G is heated to 119° C. or higher by use of heat rollers and thereafter cooled slowly, the entire surface of the recording layer 4 comes to a scattering state. The recording layer 4 in this state is seen as white to an observer viewing from the direction "A".

When the recording medium 1G is partly heated and cooled rapidly with a thermal head which generates heat in accordance with image information, the heated part shows a color depending on the temperature. In FIG. 9*b*, the reference symbol 4*a* denotes a heated reflection part. When writing by use of a thermal head is performed at 95° C., a green display on a white background can be viewed from the direction "A". The thermal printer shown by FIG. 12 can be used.

The part denoted by the reference symbol 4*b* in FIG. 15*b* is a transparent part which was heated to 119° C. or higher and thereafter cooled rapidly. This part is seen to be the color of the intermediate layer 3, that is, black from the direction "A". Therefore, when writing is performed at 119° C. or higher, a black display on a white background can be obtained. The part denoted by the reference symbol 4*c* is a scattering part which was heated by heat rollers and thereafter cooled slowly, and this part is a margin where the thermal head does not perform writing. Moreover, when writing is performed at 87° C., 95° C., 115° C. and a temperature not lower than 119° C., a red display, a green display, a blue display and a black display can be viewed, and thus, a full-color display is possible. In the tenth embodiment, in order to make a low-reflectance display, for example, in order to make a display of dark blue partly, minuscule blue portions and minuscule black portions are arranged in mosaic in that part. Thereby, the part can be viewed as dark blue macroscopically.

In the tenth embodiment, the melting point of the base layer 2 is not lower than 200° C.; the melting point of the intermediate layer is not lower than 200° C.; and the melting point of the protective layer 5 is not lower than 200° C. The phase transit temperature of the recording layer 4 at which the liquid crystal compound contained therein changes from the liquid crystal phase to the isotropic phase is 119° C. Therefore, during writing or erasing operation, even if the recording layer 4 is heated to 119° C. or higher and is liquefied, as long as the temperature is kept lower than the melting points of the base layer 2, the intermediate layer 3 and the protective layer 5, the mechanical strength of the layers 2, 3 and 5 can be maintained, and the thickness of the recording layer 4 can be maintained against the pressure applied from the thermal head. In order to maintain the thickness more positively, spherical spacers are mixed in the recording layer 4.

Specific examples of the materials and the fabrication method of the rewritable thermosensible recording medium 1G according to the tenth embodiment are described below.

First Example of the Tenth Embodiment

Carbon black, which serves as a light absorbent, was dispersed in silicone resin (YR3370 made by Toshiba Silicone), and this was dissolved in an isopropyl alcohol solution mixed with a catalyst (CR15 made by Toshiba Silicone). This solution was coated on a sheet of composite paper and was dried and set to have a thickness of 5 μm. Thus, a black intermediate layer 3 with a light absorbing function was formed.

Next, toluene and the liquid crystal compound of the chemical formula (A) were mixed and dissolved with each other at a ratio by weight of 100 to 10. This solution was coated by a blade on the intermediate layer 3 and was heated and dried to be made into a rewritable thermosensible recording layer 4 with a thickness of 10 μm. Further, a polyester film with a thickness of 3 μm was laid on the recording layer 4 and was joined thereto by being heated to 100° C. Then, the sides were sealed with an adhesive (Alonalfar made by Toa Gosei Co., Ltd.). Thus, a protective layer 5 was formed.

In the first example, a part of the recording layer 4 where writing by use of a thermal head was performed at 120° C. became transparent, and accordingly, a black image with a good contrast to a white background could be obtained. Also, when writing by use of a thermal head at 87° C., 95° C. and 115° C., a red image, a green image and a blue image with a good contrast to a white background could be obtained, respectively. When the recording medium 1G passed between heat rollers which were heated to 120° C. and thereafter cooled slowly, the entire surface of the recording layer 4 comes to a translucent scattering state.

Second Example of the Tenth Embodiment

Phthalocyanine pigment, which serves as a light absorbent, was dispersed in silicone resin (YR3370 made by Toshiba Silicone), and this was dissolved in an isopropyl alcohol solution mixed with a catalyst (CR15 made by Toshiba Silicone). This solution was coated on a sheet of quality paper and was dried and set to be made into a blue intermediate layer 3 with a thickness of 5 μm. Silica spacers with an average particle diameter of 15 μm were dispersed in ethanol and sprayed on the intermediate layer 3.

Next, the cholesteric liquid crystal compound of the chemical formula (A) and bifunctional acrylate R712 (made by Nippon Kayaku Co., Ltd.) with an aromatic ring containing a photopolymerization initiator DAROCUR1173 (made by Chiba-Geigy (Japan)) at 3 wt % were mixed with each other at a ratio by weight of 8 to 2. Thus, a liquid crystal mixture was prepared. This liquid crystal mixture was coated on the intermediate layer 3, and a transparent polyether sulfone film with a thickness of 2 μm was laid on the liquid crystal mixture as a protective layer 5.

Then, while the protective layer 5 was pressed, ultraviolet rays of 0.02 mW/cm$^2$ were radiated for one hour, and further, ultraviolet rays of 0.25 mW/cm$^2$ were radiated for another hour. Thus, a color rewritable thermosensible recording layer 4 with a thickness of 15 μm was formed.

In the second example, a part of the recording layer 4 where writing by use of a thermal head was performed at 120° C. became transparent. The other parts which keep in a translucent scattering state became white, and a blue image with a good contrast to a white background could be obtained. Also, when the recording medium 1G passed between heat rollers which were heated to 120° C. and thereafter was cooled slowly, the entire surface of the recording layer 4 came to a translucent scattering state.

Third Example of the Tenth Embodiment

Carbon black, which serves as a light absorbent, was dispersed in copolymer nylon (CM8000 made by Toray Industries, Inc.), and this was dissolved in an isopropyl alcohol solution. This solution was coated on a sheet of composite paper and was dried to be made into an intermediate layer 3 with a thickness of 5 μm. Next, the liquid crystal compound of the chemical formula (A) mixed with silica spacers with an average particle diameter of 15 μm and bifunctional acrylate R712 (made by Nippon Kayaku Co., Ltd.) with an aromatic ring containing a photopolymerization initiator DAROCUR1173 (made by Chiba-Geigy (Japan)) at 3 wt % were mixed with each other at a ratio by weight of 8 to 2. Thus, a liquid crystal mixture was prepared. This liquid crystal mixture was coated on the intermediate layer 3, and a transparent PET (polyethilene telephthalate) film with a thickness of 2 μm was laid on the liquid crystal mixture as a protective layer 5.

Then, while the protective layer 5 was pressed, ultraviolet rays of 15 mW/cm$^2$ were radiated for five minutes. Thus, a color rewritable thermosensible recording layer 4 with a thickness of 15 μm was formed.

In the third example, a part of the recording layer 4 where writing by use of a thermal head was performed at 120° C. became transparent. The other parts which were left in a translucent scattering state became white, and a black image with a good contrast to the white background could be obtained. When writing by use of a thermal head was performed at 87° C., 95° C. and 115° C., a red image, a green image and a blue image could be obtained, respectively, and each of the images had a good contrast to the white background. When the recording medium passed between heat rollers which were heated to 120° C. and thereafter cooled slowly, the entire surface of the recording layer 4 came to a translucent scattering state.

Fourth Example of the Tenth Embodiment

Perylene pigment, which serves as a light absorbent, was dispersed in silicone resin (YR3370 made by Toray Industries, Inc.), and this was dissolved in an isopropyl alcohol solution mixed with a catalyst (CR15 made by Toshiba Silicone). This solution was coated on a sheet of quality paper and was dried to be made into a red intermediate layer 3 with a thickness of 3 μm. Next, the liquid crystal compound of the chemical formula (A) and bifunctional acrylate R712 (made by Nippon Kayaku Co., Ltd.) with an aromatic ring, containing a photopolymerization initiator DAROCUR1173 (Chiba-Geigy (Japan)) at 3 wt % were mixed with each other at a ratio by weight of 8 to 2. Thus, a liquid crystal mixture was prepared. This liquid crystal mixture was coated on the intermediate layer 3, and ultraviolet rays of 0.02 mW/cm$^2$ were radiated for one hour. Further, ultraviolet rays of 0.25 mW/cm$^2$ were radiated for another hour. Thereby, a color composite film (rewritable thermosensible recording layer 4) with a thickness of 20 μm was formed.

In the fourth example, a part of the recording layer 4 where writing by use of a thermal head was performed at 120° C. became transparent. The other parts which were left in a translucent scattering state became white, and a red image with a good contrast to the white background could be obtained. When the recording medium 1G passed between heat rollers which were heated to 120° C. and thereafter was cooled slowly, the entire surface of the recording layer 4 came to a translucent scattering state.

Eleventh Embodiment

As FIG. 9 shows, a recording medium 1H as the eleventh embodiment is of the structure wherein the intermediate layer 3 of the tenth embodiment is omitted. The base layer 2, the recording layer 4 and the protective layer 5 used for the tenth embodiment can be used for this eleventh embodiment.

As described in connection with the tenth embodiment, if a light absorbing material is used for the base layer 2, by making the entire surface of the recording layer 4 come to a translucent scattering state and thereafter performing writing by use of a thermal head for the respective colors, a quality full-color image can be obtained on a white background. Also, if a material which reflects part of visible light is used for the base layer 2, by making the entire surface of the recording layer 4 come to a translucent scattering state and thereafter performing writing by use of a thermal head for transparence, an image of the color reflected by the base layer 2 can be reproduced well on a white background. In this case, the base layer 2 is preferably opaque.

Twelfth Embodiment

According to the twelfth embodiment, a near infrared ray absorbent is dispersed in the intermediate layer 3 and/or the protective layer 5 of the tenth embodiment shown by FIGS. 15*a* and 15*b* so that the intermediate layer 3 and/or the protective layer 5 can have a function of converting infrared rays into heat. Otherwise, the intermediate layer 3 and/or the protective layer 5 may be made of an infrared ray absorbing material. The twelfth embodiment, although not shown in the drawings, imparts a function of absorbing infrared rays to the periphery of the recording layer 4, and information can be written in a recording medium of the twelfth embodiment effectively by use of the laser printer shown by FIG. 14.

Thirteenth Embodiment

Figure 11:
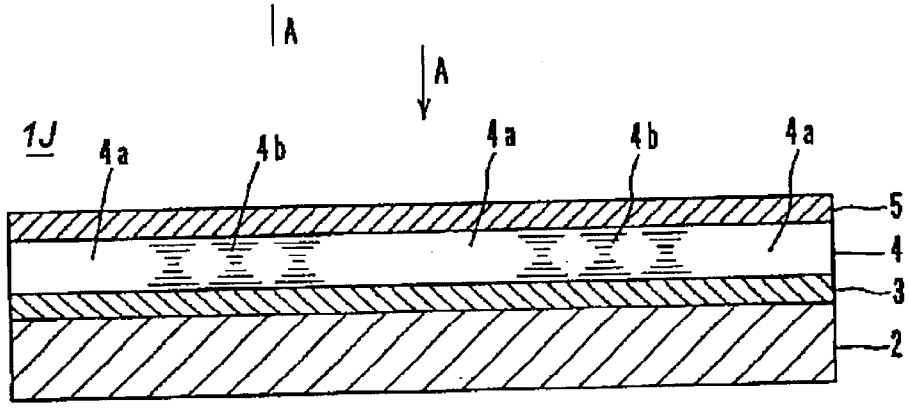
FIG. 11 is a cross-sectional view showing a thirteenth example of the recording medium.

In FIG. 11, a reversible heat-sensitive recording medium 1A, comprising a first example, includes a base layer 2, a middle layer 3, a recording layer 4, and a protective layer 5, stacked in that order from the bottom. The base layer 2 comprises a pliable sheet-like material, such as paper, polycarbonate, or PET (polyethylene terephthalate). The middle layer 3 includes a component capable of absorbing visible light, and the surface that is in contact with the recording layer 4 (that is, the upper surface of the middle layer 3) is formed so as to be smoother than the top surface of the base layer 2. Specifically, the middle layer 3 may be formed by dispersing carbon black in silicone resin. A catalyst and isopropyl alcohol are then added to the resin. The isopropyl alcohol solution thus obtained is then applied to the base layer 2. After it is dried to harden by heat, a middle layer 3 results.

Where the middle layer 3 is colored and semi-transparent, it is preferred, in order to reproduce high quality full-color images, that the base layer 2 absorb light by itself or in combination with the middle layer 3. While a transparent layer may be used for the middle layer 3, if such a layer is used, it is preferred that the base layer 2 be capable of light absorption.

The recording layer 4 is a liquid crystal layer including a low-molecular weight cholesteric liquid crystal compound. Specifically, the recording layer 4 may be formed by dissolving dicholesteryl 10, 12-docosadiynedioate in toluene, and applying the solution obtained to the middle layer 3 by means of a blade and then heating and drying the layer. The product thus obtained is the reversible heat-sensitive recording layer 4. The thickness of the recording layer 4 should be between 3 and 50 $\mu$m, and preferably between 6 and 30 $\mu$m.

Using the recording medium 1A of this example, when it is heated to 87 to 115° C., it exhibits a cholesteric phase in which the helical axes of the molecules of the cholesteric liquid crystal compound become vertical to the middle layer 3, and thus reflects the light of a specific wavelength depending on the temperature. This cholesteric liquid crystal compound reflects red light at approximately 87° C., green light at approximately 95° C., and blue light at approximately 115° C. When it is rapidly cooled from any of these temperatures, the cholesteric liquid crystal compound hardens at the reflection state that was present when the temperature was higher.

In addition, this cholesteric liquid crystal compound becomes transparent when it is heated to 119° C. or higher and then rapidly cooled. In other words, if the entire surface of the recording medium 1A is heated to 119° C. or higher and then rapidly cooled, the entire surface of the recording layer 4 becomes transparent. When this occurs, the observer who looks at the recording medium 1A from the direction of the arrow A sees a black background because the visible light is absorbed by the middle layer 3.

When the recording medium 1A in this state is partially heated and rapidly cooled in response to image information, the heated area displays the reflection color corresponding to the temperature to which the area was heated. In FIG. 11, 4*a* indicates the transparent areas, while 4*b* indicates the areas that remain in the cholesteric phase. Therefore, if writing is performed at 95° C., a green display on a black background can be seen from the direction of the arrow A. If writing is performed at a combination of 87° C., 95° C. and 115° C., a full-color display is possible. Additionally, by mixing black display regions in an area in which a low reflectance is desired, the reflectance can be reduced accordingly.

In the recording medium 1A, the display colors of the liquid crystal are observed against a black background. Where a coloring agent that reflects visible light of a specific wavelength is added to the middle layer 3, the display colors of the liquid crystal are observed against a background of a single color that corresponds to the specific wavelength. If display is to be performed against a white background, it can be achieved by displaying minute areas of blue, green and red in a mosaic fashion in the areas for which there is no display information, so that a white background may be displayed in a macroscopic fashion.

On the other hand, if the cholesteric liquid crystal compound is heated to 119° C. or higher and then gradually cooled, the molecules become scattered and the compound becomes opaque. In other words, if the entire surface of the recording medium 1A is heated to 119° C. or higher and then gradually cooled, the molecules of the entire surface of the recording layer 4 become scattered. When this occurs, a white background is displayed to the observer who observes the recording medium 1A from the direction of the arrow A.

Figure 12:
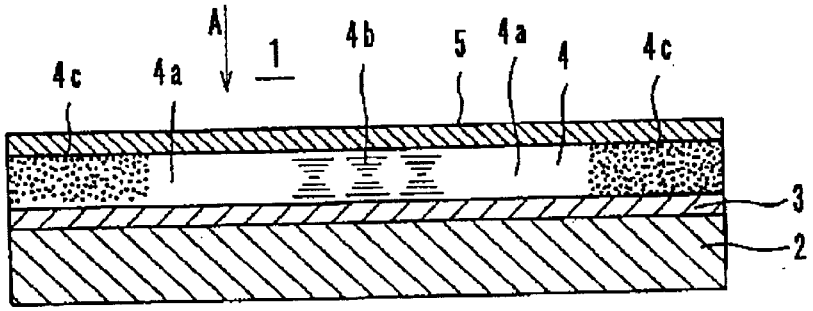
FIG. 12 is a cross-sectional view showing a display state different from FIG. 11 in the recording medium of the thirteenth example.

When the recording medium 1A in this state is partially heated and then rapidly cooled in response to the image information, the heated area displays a reflection color depending on the temperature to which the area was heated. In FIG. 12, 4*a* indicates the areas that were heated and are reflecting light. Therefore, if writing is performed at 95° C., a green display against a white background may be observed from the direction of the arrow A.

The areas indicated by 4*b* are the areas that were heated to 119° C. or higher and then rapidly cooled, and are now transparent. These areas exhibit the color of the middle layer 3, that is black, when seen from the side of the observer (the direction of the arrow A). Therefore, if writing is performed at 119° C. or higher, a black display against a white background is obtained. The areas indicated by 4*c* were gradually cooled after being heated and are in a scattered-molecule state. They comprise the margin areas where no writing is generally performed. If writing is performed at 87° C., 95° C., 115° C. and 119° C. or higher, a full-color display is possible. In this first example, by mixing black display regions in an area in which a low reflectance is desired, the reflectance can be reduced accordingly.

Fourteenth Embodiment

Figure 13:
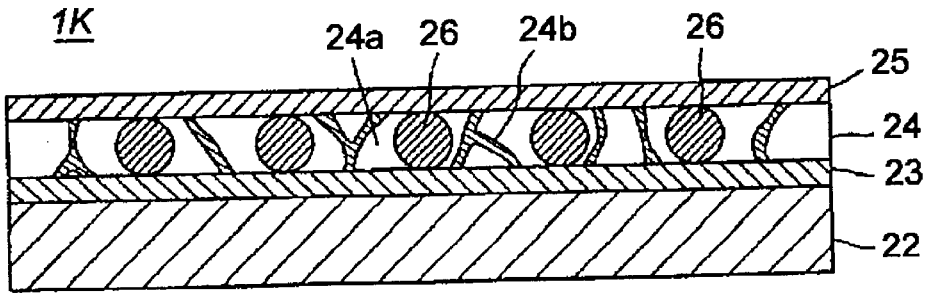
FIG. 13 is a cross-sectional view showing a fourteenth example of the recording medium.

In FIG. 13, the reversible heat-sensitive recording medium 1K, comprising a second example, includes a base layer 22, a middle layer 23, a recording layer 24 and a protective layer 25, stacked together in that order from the bottom. The layers are the same as those in the first example except for the recording layer 24. The recording layer 24 comprises a composite film of a low-molecular weight cholesteric liquid crystal compound and a high-molecular weight resin. It is separated into a liquid crystal component 24*a* and a resin film 24*b*, and spherical spacers 26 comprising resin and inorganic oxides are included as well. Image recording by means of the recording layer 24 is accomplished the same as in the prior example.

II. Liquid Crystal Composition

As the low molecular cholesteric liquid crystal compound to be a component of the recording layer, various ones as well as the one of the chemical formula (A) can be used.

Specifically, one additional category of liquid crystal material composition that has been proposed by the present inventors, and which was previously unknown, is defined below by the illustrated chemical formula (B) below.

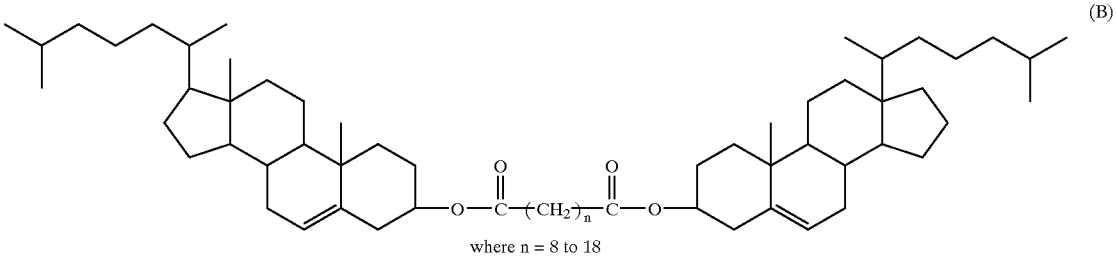

In the above chemical compound, as indicated above, n may be a natural number from 8 to 18. Thus, eleven types of chemical compounds satisfy the above relation.

III. Construction of Image Recording Apparatus

Thermal Printer

Figure 14:
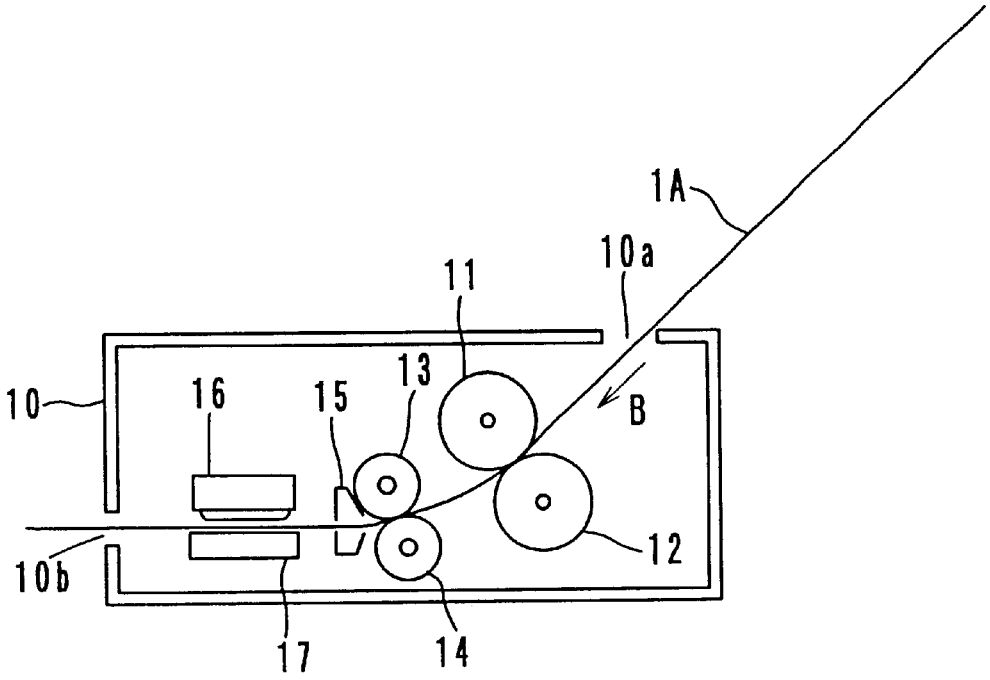
FIG. 14 is a schematic view of a thermal printer.

FIG. 14 shows a thermal printer for writing information in the recording medium 1A. This printer is has conveyance rollers 11 and 12, heat rollers 13 and 14, a cooler 15, a thermal head 16 and a platen 17 arranged in a housing 10 in this order along a direction "B" in which the recording medium 1A is fed.

The recording medium 1A enters the printet by way of an entrance 10*a* thereof, is sent from the conveyance rollers 11 and 12 between the heat rollers 13 and 14, where it is heated to 119° C. or higher. Thereafter, it is rapidly cooled by the cooler 15. In this way, the information which has been recorded in the recording medium 1A is erased. Then, the recording medium 1A is conveyed between the platen 17 and the thermal head 16 where required information is written therein. Specifically, a driver circuit (not shown) controls the heating operation of the thermal head 16 in accordance with image information inputted from an external device, and the thus controlled thermal head 16 writes information in the recording medium 1A. After the recording medium 1A is heated by the thermal head 16 into a display state, naturally, it is rapidly cooled. Then, with the written information solidified, the recording medium 1A is delivered by way of an outlet 10*b*.

The recording medium 1A is rapidly cooled naturally after passing by heating members of the thermal head 16. Therefore, no cooling means is required for the recording medium 1A. For more positive cooling operation, however, the cooler 15 can be provided as in the embodiment mentioned above, or another cooler can be arranged downstream of the thermal head 16.

Figure 15:
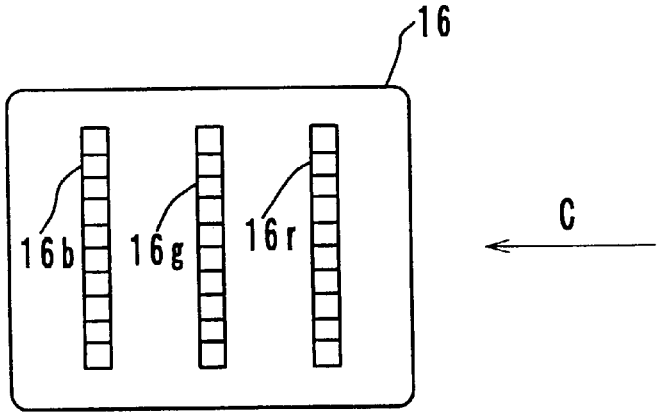
FIG. 15 is a schematic view of a thermal head of the thermal printer.

The thermal head 16, as shown in FIG. 15, has three heating members 16*r*, 16*g* and 16*b* juxtaposed in a direction at a right angle to the direction recording medium traveling "B". The heating member 16*r* is for writing red, the heating member 16*g* is for writing green, and the heating member 16*b* is for writing blue. Each of the heating members 16*r*, 16*g* and 16*b* has a multiplicity of pixel components aligned in the direction "B". The heating members 16*r*, 16*g* and 16*b* are to heat the recording layer 4 of the recording medium 1A to approximately 87° C., approximately 95° C. and approximately 115° C., respectively.

The thermal head 16 is constructed to reciprocate in the direction "C" (the direction perpendicular to the page of FIG. 14) at a right angle to the recording medium traveling direction "B" in synchronism with the motion of the recording medium 1A. The heating members 16*b*, 16*g* and 16*r* are turned on and off in accordance with image information of the respective colors while moving in the direction "C". By repeating the heating and non-heating, an image is written in the recording medium 1A as many lines as the pixel components arranged in a line at a time, thereby finally reproducing a full-color image on the recording medium 1A. The writing operation is performed by the heating members preferably in the descending order of temperature, i.e. by the blue heating member 16*b*, the green heating member 16*g* and the red heating member 16*r* in this order. It is possible to write the three colors with a single heating member; however, this requires a complicated temperature control. Therefore, it is preferred to write the three colors with different heating members.

In the first embodiment, the intermediate layer 3 with carbon black added thereto has a function of absorbing visible light in the full wavelength range. However, if the intermediate layer 3 is imparted with a function of reflecting blue light and if writing is performed so that the liquid crystal compound reflects yellow light, display in blue and white is possible. Of course, a plurality of colors can be displayed using a similar method. In this method, the reflection amount of white is the sum of the blue reflection amount of the intermediate layer 3 and the yellow reflection amount of the recording layer 4. The resulting reflection amount is greater than the reflection amount for white display with the three primary colors of blue, green and red arranged in mosaic, thus resulting in a brighter display. Also, a more colorful display becomes possible by making the intermediate layer 3 reflect a plurality of colors.

Laser printer

Figure 16:
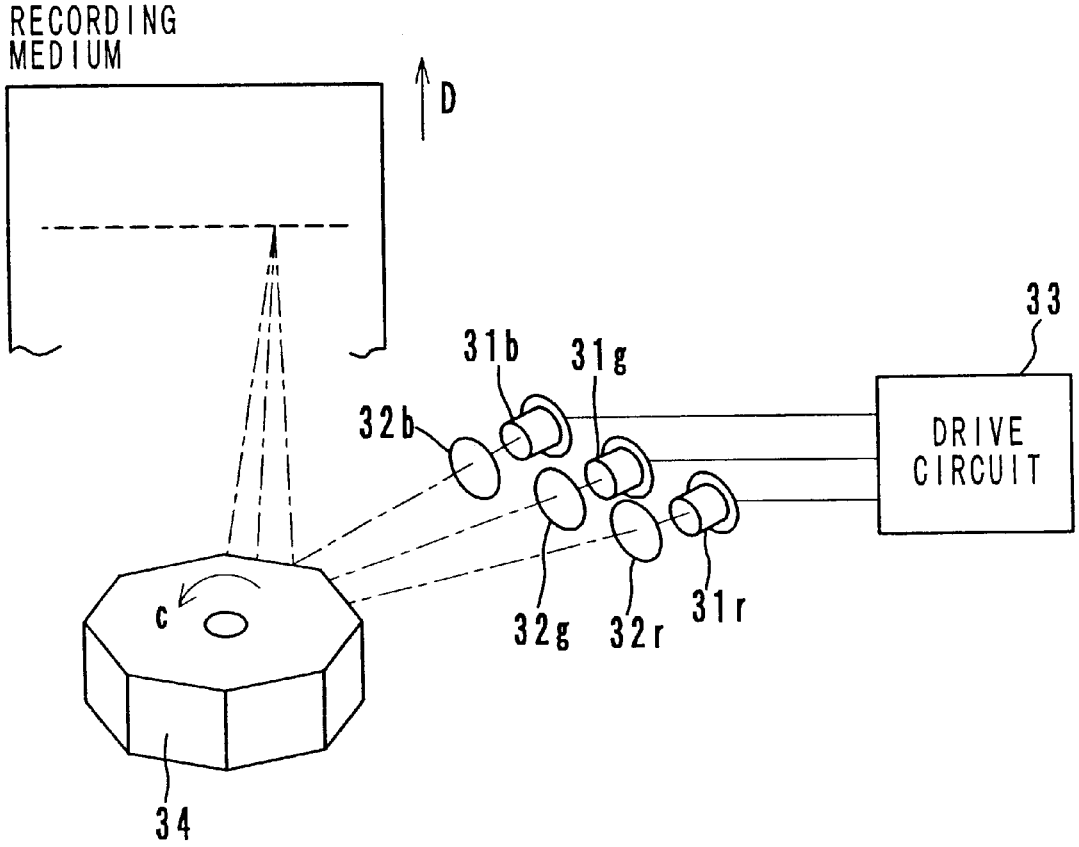
FIG. 16 is a schematic perspective view of a laser printer.

The configuration of a laser printer for writing information in the recording medium according to the sixth embodiment is schematically shown in FIG. 16. This printer has laser diodes 31*b*, 31*g* and 31*r* for writing blue, green and red, respectively. These laser diodes 31*b*, 31*g* and 31*r* are modulated by a drive circuit 33, and laser beams emitted from the laser diodes 31*b*, 31*g* and 31*r* are incident to a polygon mirror 34 through collimator lenses 32*b*, 32*g* and 32*r*. The polygon mirror 34 is rotated in the direction of arrow "c". With the rotation, the laser beams are deflected to scan the recording medium linearly, while the recording medium is conveyed along the direction of arrow "D". Thus, two-dimensional full-color information is written in the recording medium.

Though not shown, the laser printer also has such an optical element as an fθ lens.

The color to be written is determined by controlling the radiation energy of the laser diodes 31*b*, 31*g* and 31*r*. It is also possible to write the colors with a single laser diode by controlling the energy of the laser beam for the respective colors. The energy control, however, is easier when three laser diodes are used to write information in the three colors separately.

Thermal Printer

Figure 17:
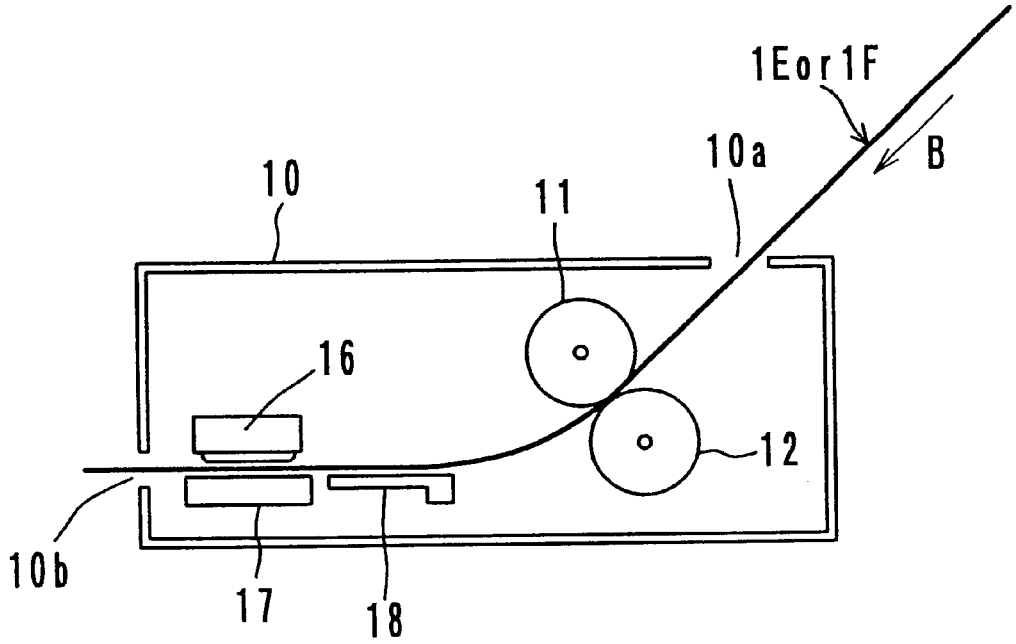
FIG. 17 is a schematic view of another thermal printer.

FIG. 17 shows a thermal printer for writing information in the recording media 1E and 1F. This printer is basically of the same structure as the printer shown by FIG. 14. In an housing 10, conveyance rollers 11 and 12, a heating/cooling plate 18, a thermal head 16 and a platen 17 are provided in the recording medium traveling direction "B" in this order. The heating/cooling plate 18 is to heat and slowly cool the recording medium 1E or 1F. The plate 18 has a heater in a part near the conveyance rollers 11 and 12, and as the recording medium 1E or 1F is traveling farther from the rollers 11 and 12, it is slowly cooled.

The recording medium 1E or 1F enters the printer through an entrance 10*a* and is conveyed to the heating/cooling plate 18 through the conveyance rollers 11 and 12. First, the recording medium 1E or 1F is heated to an erasing temperature not lower than 119° C. and thereafter is cooled slowly. Thereby, information which has been recorded on the medium is erased. Next, the recording medium 1E or 1F is conveyed between the platen and the thermal head 16, where necessary information is written thereon. The recording medium 1E or 1F is heated by the thermal head 16 to have a display thereon and thereafter naturally is cooled rapidly. Thereby, the display is fixed thereon, and the recording medium 1E or 1F is ejected from the printer through an exit 10*b*.

Since the recording medium 1E or 1F is naturally cooled rapidly after passing by heating members of the thermal head 16, a cooling device is basically unnecessary. For more positive cooling operation, however, a cooler can be provided in a position downstream of the thermal head 16.

It is desired that the width of the heating/cooling plate 18 is larger than the width of the writing range wherein the thermal head 16 writes information. With this arrangement, even if the recording medium 1E or 1F is conveyed slightly displaced in the width direction, the information written in the recording medium can be erased certainly. Further, in order to perform erasing uniformly on the entire surface of the recording medium 1E or 1F, preferably, the width of the heating/cooling plate 18 is larger than the width of the recording medium 1E or 1F.

Figure 18:
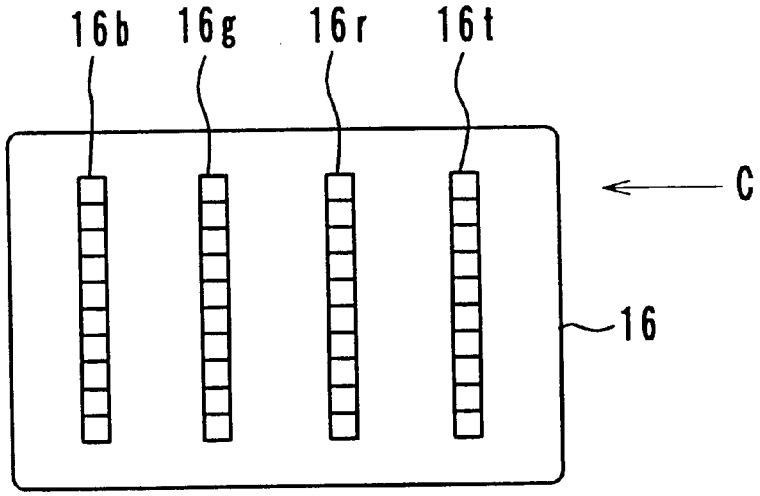
FIG. 18 is a plan view of a thermal head of the thermal printer shown by FIG. 17.

As FIG. 18 shows, the thermal head 16 has four heating members 16*t*, 16*r*, 16*g* and 16*b* which are juxtaposed in a direction perpendicular to the recording medium traveling direction "B". The heating member 16*t* is to write a transparent image; the heating member 16*r* is to write a red image; the heating member 16*g* is to write a green image; and the heating member 16*b* is to write a blue image. Each of the heating members 16*t*, 16*r*, 16*g* and 16*b* has a multiplicity of pixel components which are aligned in the recording medium traveling direction "B". The heating members 16*t*, 16*r*, 16*g* and 16*b* are to heat the recording layer 4 to approximately 120° C., approximately 87° C., approximately 95° C. and approximately 115° C., respectively.

The thermal head 16 is so constituted to reciprocate in the direction "C" perpendicular to the recording medium traveling direction "B" in synchronization with the movement of the recording medium 1E or 1F. The heating members 16*t*, 16*r*, 16*g* and 16*b* are turned on and off in accordance with image information of the respective colors while moving in the direction "C". The thermal head 16 writes as many lines as the number of pixel components arranged in each line at a time, and by repeating the heating process and the non-heating process, the thermal head 16 reproduces a full-color image on the recording medium 1E or 1F. The writing is preferably performed in order of necessary temperature. Specifically, it is preferred that the transparent heating member 16*t*, the blue heating member 16*b*, the green heating member 16*g* and the red heating member 16*r* perform writing in this order. Further, it is possible to write in transparent and the three colors with a single heating member; however, it requires a complicated temperature control, and it is preferred that writing is performed with four heating members.

When a color display on a white background is desired or when a color display is to be made by writing with the transparent heating member 16*t* to make the color of the base layer appear, the recording medium. 1E or 1F is reset to a translucent scattering state, and writing is performed in portions with image information on the recording medium 1E or 1F with the heating member of that color or the transparent heating member (character writing). On the other hand, a white display on a transparent background is desired, the recording medium 1E or 1F is reset to a translucent scattering state, and writing is performed in portions with no image information on the recording medium 1E or 1F with one of the color heating members or the transparent heating member (background writing).

In color writing, when writing is performed with mutually different reflection wavelengths selected in a plurality of portions, characters of a plurality of colors can be written.

Laser Printer

Figure 19:
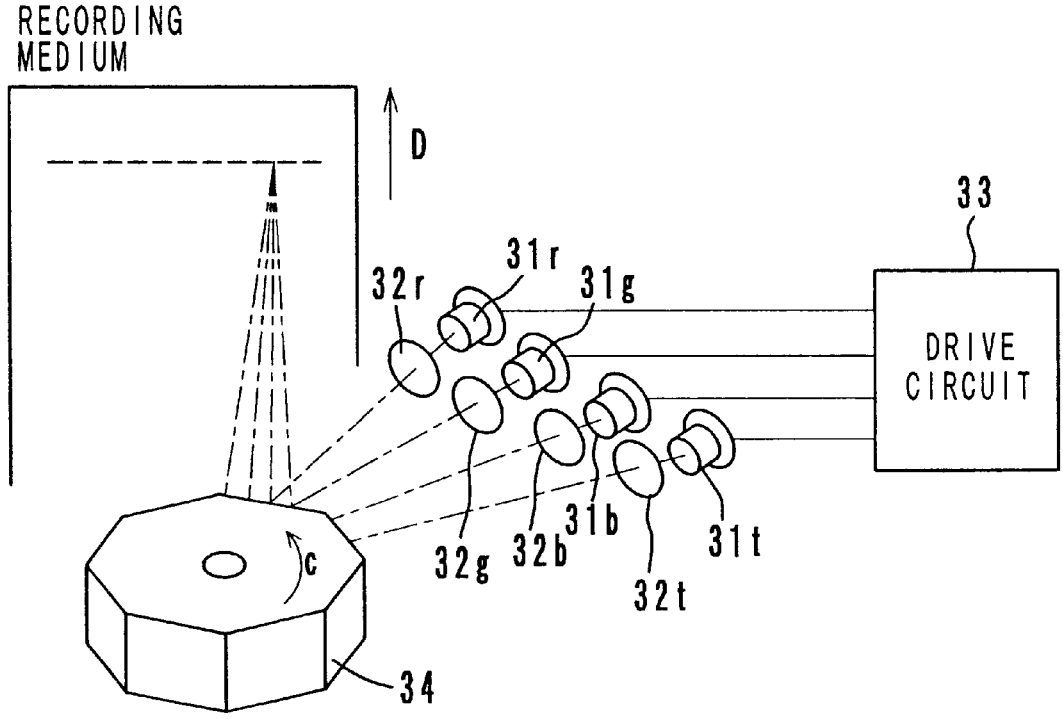
FIG. 19 is a schematic perspective view of another laser beam.

FIG. 19 is a schematic view of a laser printer for writing information on the recording medium of the ninth embodiment. This printer is basically of the same structure as the printer shown by FIG. 16. Laser diodes 31*t*, 31*b*, 31*g* and 31*r* for writing of a transparent image, a blue image, a green image and a red image, respectively, are modulated by a driving circuit 33. Laser beams emitted from the laser diodes 31*t*, 31*b*, 31*g* and 31*r* are incident to a polygon mirror 34 through collimator lenses 32*t*, 32*b*, 32*g* and 32*r*, respectively. The polygon mirror 34 are driven to rotate in the direction of arrow "c", and with this rotation, the laser beams are deflected and scanned linearly on the recording medium 1. Meanwhile, the recording medium is conveyed in the direction of arrow "B", and thus, image information is written thereon two-dimensionally.

Although they are not shown, optical elements such as an fθ lens are provided in the laser printer.

Color selection is realized by controlling radiation energy of the laser diodes 31*t*, 31*b*, 31*g* and 31*r*. Therefore, it is possible to write a full-color image with a single laser diode by controlling the energy of the laser beam for the respective colors. However, when four laser diodes are used to write the colors separately, energy control is easier.

Such an optical writing method as the above-described laser beam method has the advantage that a clearer image can be obtained in a case of background writing.

Thermal Printer

Figure 20:
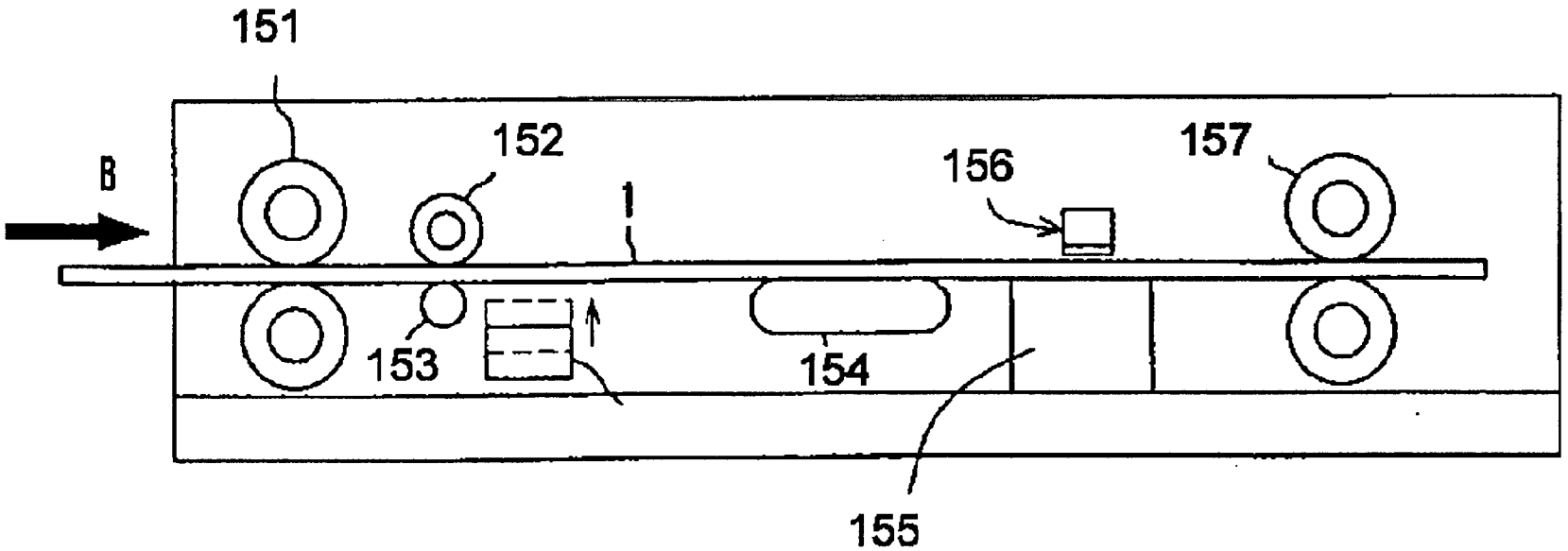
FIG. 20 is a drawing showing the basic construction of a thermal printer in another embodiment of the present invention.

FIG. 20 shows a thermal printer in another embodiment of the present invention. This printer comprises a pair of conveyor rollers 151, an image erasing roller 152, a support roller 153, a preliminary heating plate 154, a support plate 155, a heater or a thermal head 156, a pair of conveyor rollers 157 and a slow cooling member 158.

Using the thermal printer described above, the recording medium 1 is (i) inserted into the printer from the direction of the arrow B, (ii) conveyed by the rollers 151, 152 and 153, and (iii) heated to 120° C. by means of the erasing roller 152. Where image writing is to be performed against a white background, slow cooling member 158 is activated to gradually cool the recording medium 1, so that the recording layer 4 will enter a scattered-molecule state, i.e., an opaque state. Where writing is to be performed against a black background, the slow cooling member 158 is not activated, so that the recording medium 1 will be rapidly cooled through natural cooling and the recording layer. 4 will become transparent. It is also acceptable if the operator can select which type of image writing will take place, i.e., whether or not the slow cooling member 58 will be activated. By making the recording layer 4 white or transparent in this way, the images previously recorded are erased. The recording medium 1 is then conveyed onto the support plate 155 via the preliminary heating plate 154. The preliminary heating plate 154 is controlled such that it maintains a certain constant temperature and heats the recording medium 1 to a certain constant temperature (40° C., for example) regardless of the ambient temperature.

The recording medium 1 that has undergone preliminary heating passes over the support plate 155. In synchronization with this, the thermal head 156 is driven while being moved forward and backward in the directions C and C' (FIGS. 21 and 22) that are perpendicular to the direction of conveyance B. Through this driving of the thermal head 156, image writing is performed on the recording medium 1. The construction of the thermal head 56 and the manner in which recording takes place are explained in detail below. Because the areas heated by the thermal head 156 are very small in relation to the overall area of the recording medium 1, and because the supporting plate 155 is made of metal having good heat conductivity, the heated areas are instantly cooled and the display colors become fixed. The recording medium 1 onto which recording has been completed is ejected outside the printer by means of the pair of conveyor rollers 157.

Explanation of Thermal Head

Figure 21:
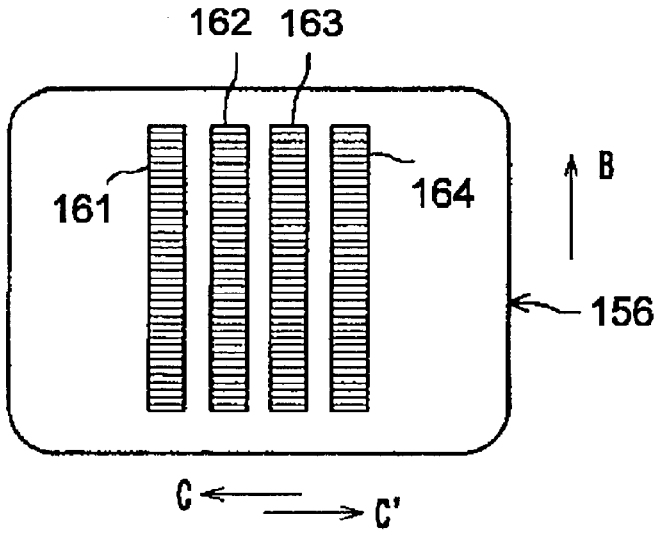
FIG. 21 is a plan view showing the thermal head used in the thermal printer of FIG. 20.

The thermal head 156 includes four heating arrays 161 through 164, as shown in FIG. 21. These heating arrays 161 through 164 are located in the directions C and C', that is perpendicular to the recording medium's direction of conveyance B, such that they are distanced from one another at prescribed intervals. The heating arrays 161 through 164 each include multiple heating elements that are located along the direction of conveyance of the recording medium. This thermal head 156 is moved forward and backward along the entire width of the recording medium by means of a scanning mechanism not shown in the drawings, such that it scans the recording medium, and each heat generating element is controlled so that it may be turned ON or OFF during this scanning. Through this operation, images are written in the recording medium 1 on a pixel-by-pixel basis.

Each heating array 161 through 164 is allocated a writing color, and writing takes place along the scanning directions in a sequential fashion with the highest temperature heating array preferably being first. This is done in order to prevent the images that have already been written from being changed by the images that are subsequently written (heated). In other words, when the thermal head 156 moves in the direction A of the arrow C, the heating array 161 writes transparently (120° C.), the heating array 162 writes in blue (115° C.), the heating array 163 writes in green (95° C.), and the heating array 64 writes in red (87° C.). The control of the heating temperatures is performed based on the voltage applied to each heating array 161, 162, 163 or 164.

On the other hand, in order to increase the writing speed, writing should be performed during both the forward and backward movement of the thermal head 156. In this case, however, it is necessary to have the same writing temperature sequence during forward and backward movement. As one method, an electric control method in which the voltages that are applied to the heating arrays 161 through 164 are switched between the forward movement and the backward movement. In other words, when the thermal head 156 moves backward in the direction of the arrow C', control should be performed so that the heating array 164 writes transparently, the heating array 163 writes in blue, the heating array 162 writes in green and the heating array 161 writes in red, in a reverse fashion from the forward movement.

Figure 22:
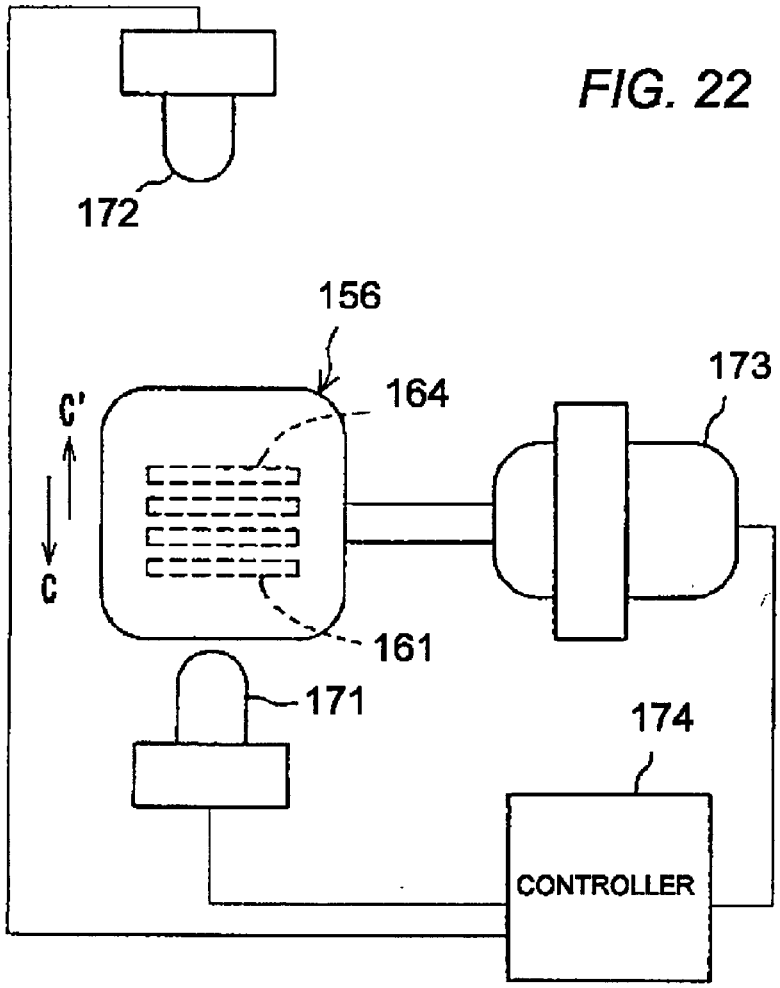
FIG. 22 is a drawing showing the basic construction of the mechanism to turn the thermal head 180 degrees.

For another method, as shown in FIG. 22, a mechanical control method may be used in which the thermal head 156 is rotated 180 degrees each time forward movement or backward movement is completed. Specifically, sensors 171 and 172 are located at the point at which the thermal head's forward movement ends and at the point at which the thermal head's backward movement ends, respectively, and a solenoid 173 that rotates the thermal head 56 180 degrees is also used. The solenoid 173 can move forward and backward together with the thermal head 156. When the thermal head 156 moves forward or backward and completes a scan in that direction, the completion of scanning is sensed by the sensor 171 or 172. The sensor detection signal is input to the controller 174, which drives the solenoid 172 to rotate the thermal head 156 180 degrees. As a result of this turning, the order of the heating arrays 161 through 164 is kept constant during both forward and backward movement.

Among the two methods described above, the first method has the advantage that the mechanical construction is simple and the thermal head 156 can be made compact. On the other hand, the second method is effective when it is difficult to implement the first method due to the construction of either the thermal head 156 or the power supply voltage switching control.

Control of Image Recording Apparatus

Figure 23:
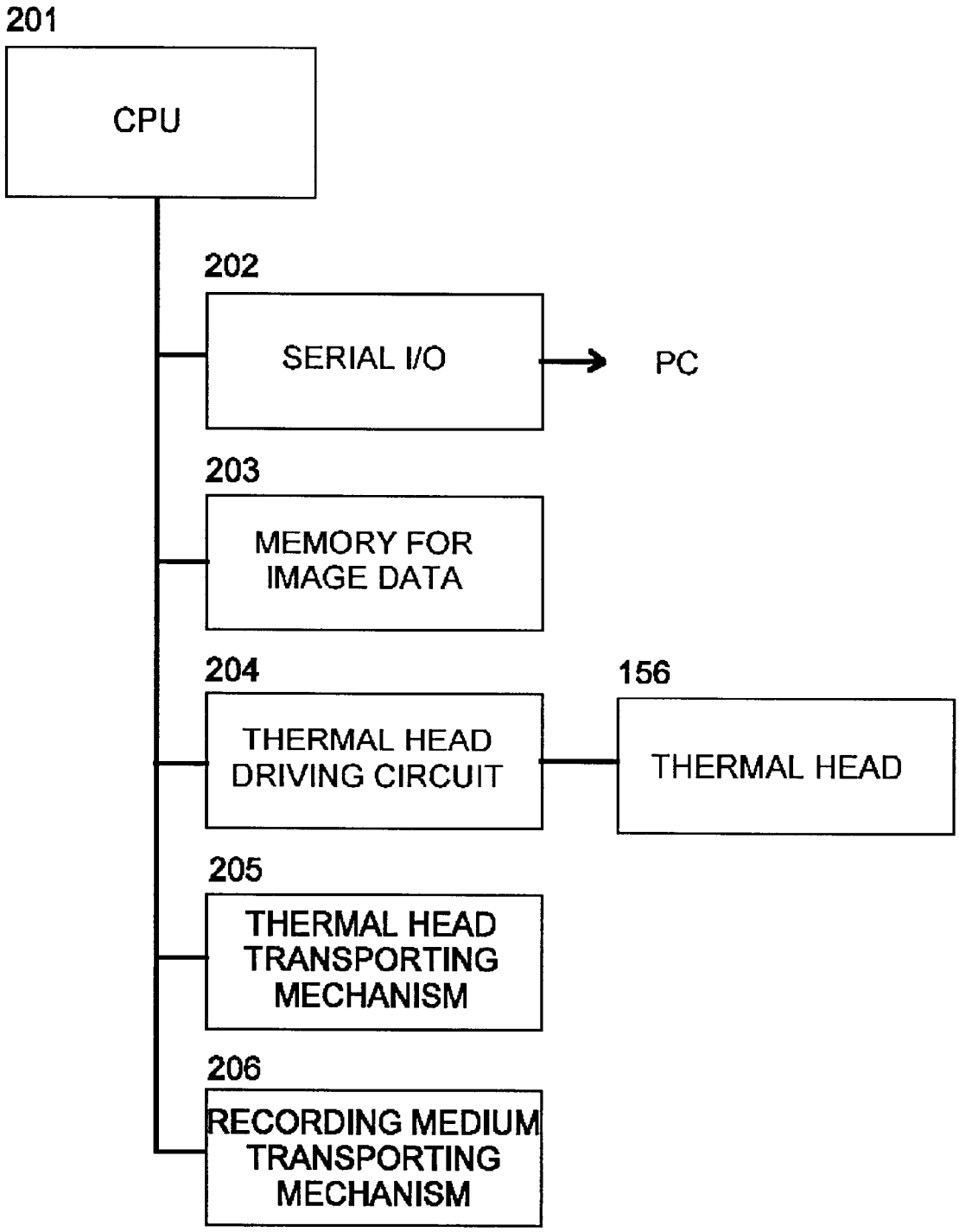
FIG. 23 is a diagram showing the control mechanism for the recording apparatus.

While a number of control arrangements will be apparent to one skilled in the art, a preferred embodiment of a control system is illustrated generally in FIG. 23.

As shown in FIG. 23, the image recording apparatus is connected to a computer such as a PC via a serial interface (I/O) 202 and the print data is transmitted from the PC as raster data and is temporarily stored in a memory 203. For each pixel, the print data comprises red, green and blue data, each of which may be expressed as an 8-bit intensity data word.

The CPU 201 outputs the print data stored in the memory 203 to the thermal head driving circuit 204. The thermal head driving circuit 204 generates electric power according to the print data so that one or more of the heating elements 161–164, of the thermal head 156, generates appropriate heat necessary for recording.

For recording an image, the thermal head transporting mechanism 205 is scanned in synchronism with the recording data under the control of the CPU 201.

Similarly, for recording an image, the recording medium transporting mechanism 206 transports the recording medium in synchronism with the recording data and with the thermal head scanning.

Other Embodiments

The image recording apparatus pertaining to the present invention is not limited to the embodiments described above. The embodiments may be modified in various fashions within the essential scope of the invention.

For example, it is acceptable if a cooling method is used that rapidly cools the recording medium immediately after image exposure. Various constructions may be used for the construction of the thermal head, or of the heating arrays in particular.

Naturally, other variations of the first and second examples may be used for the reversible heat-sensitive recording medium.

Although the present invention has been fully described by way of examples and with reference to the accompanying drawings, it is to be understood that various changes and modifications will be apparent to those skilled in the art without departing from the spirit and scope of the invention. Therefore, unless such changes and modifications depart from the scope of the present invention, they should be construed as being included therein.

What is claimed is:

1. An image recording apparatus for forming an image onto a recording medium having a recording layer containing a liquid crystalline material of which a display color varies in response to a temperature of heat applied thereto and in which the display color is fixed by cooling, said image recording apparatus comprising:

a first heater for heating the recording medium to a clearing temperature at which the liquid crystalline material exhibits an isotropic phase;

a second heater for selectively heating the recording medium that has been heated by the first heater, said second heater having a selectable temperature; and a heater driving device for driving the second heater and for selecting a recording temperature based on a color of an image to be recorded, wherein the selectable temperature of the heater is set to the thus selected recording temperature, thereby selecting the display color of the recording medium.

2. An image recording apparatus in accordance with claim 1, wherein the second heater includes a thermal head having a plurality of heating elements.

3. An image recording apparatus in accordance with claim 2, further comprising:

a scanner for moving the second heater along a scanning direction with respect to the recording medium.

4. An image recording apparatus in accordance with claim 3, further comprising:

conveying mechanism for conveying the recording medium, relative to the thermal head, in a subscanning direction.

5. An image recording apparatus in accordance with claim 3, wherein each of the plurality of heating elements is disposed on the thermal head in an orientation along the scanning direction.

6. An image recording apparatus in accordance with claim 5, wherein the heater driving device is adapted to set a respective temperature of each of the plurality of heating elements so that a leading one of said plurality of heating elements, with respect to the scanning direction, has a temperature higher than a temperature of any other one of said plurality of heating elements.

7. An image recording apparatus in accordance with claim 5, wherein said scanner is adapted to perform forward and reverse scans along the scanning direction, and wherein the heater driving device is adapted to control each of the plurality of heating elements during said forward and reverse scans so that for each of the forward and reverse scans, a corresponding leading one of said plurality of heating elements with respect to the scanning direction has a temperature higher than a temperature of any other one of said plurality of heating elements.

8. An image recording apparatus in accordance with claim 7, wherein the heater driving device is adapted to control said plurality of heating elements so that, for each of the forward and reverse scans, a temperature of each sequential one of said heating elements along the scanning direction progressively decreases from said corresponding leading one of said plurality of heating elements to a corresponding trailing one of said plurality of heating elements.

9. An image recording apparatus in accordance with claim 8, wherein the heater driving device is adapted to control a temperature of each of said plurality of heating elements so that the sequence of temperatures of the heating elements, relative to a direction of motion for each of the forward and reverse scans, is kept constant during each of the forward and reverse scans.

10. An image recording apparatus in accordance with claim 9, wherein the heater driving device is adapted to control the voltage applied to each heating element such that the sequence of temperatures of the heating elements is kept constant.

11. An image recording apparatus in accordance with claim 1, further comprising a slow cooling member, provided between the first and second heaters, for gradually cooling the recording medium that has been heated by the first heater.

12. An image recording apparatus in accordance with claim 11, further comprising a selecting mechanism for selectively introducing and withdrawing the slow cooling member from a position proximate to the recording medium.

13. An image recording apparatus in accordance with claim 3, further comprising:

a rotating apparatus for rotating the thermal head; and a rotation controller for controlling a rotation of the thermal head based on a direction of motion;

wherein the scanner is adapted to perform forward scans and reverse scans relative to the scanning direction, and wherein a sequence of heating temperatures of the heating elements for each of the forward and reverse scans is kept constant, and wherein the thermal head is rotated 180 degrees between performing forward and reverse scans along the scanning direction.

14. An image recording apparatus for forming an image onto a thermally sensitive recording medium having a recording layer containing a liquid crystalline material of which a display color varies in response to a temperature of heat applied thereto, said image recording apparatus comprising:

a first heater for heating the recording medium to a clearing temperature at which the liquid crystalline material exhibits an isotropic phase;

a second heater for selectively heating the recording medium that has been heated by the first heater;

a scanner for scanning the heater across the recording medium; and a temperature controller for controlling a temperature of the second heater during scanning, wherein the temperature controller is adapted to control a temperature of the second heater during scanning based on image data to be recorded onto the recording medium so that colors corresponding to the image data are written to the recording medium.

15. An image recording apparatus in accordance with claim 14, wherein said second heater includes a thermal head having a plurality of heating elements, a temperature of each heating element being individually controllable by said temperature controller.

16. An image recording apparatus in accordance with claim 15, wherein the scanner scans the second heater along a scanning direction with respect to the recording medium.

17. An image recording apparatus in accordance with claim 16, further comprising:

a conveying mechanism for conveying the recording member, relative to the thermal head, in a subscanning direction.

18. An image recording apparatus in accordance with claim 16, wherein each of the plurality of heating elements is disposed on the thermal head in an orientation along the scanning direction.

19. An image recording apparatus in accordance with claim 18, wherein the temperature controller is adapted to set a respective temperature of each of the plurality of heating elements such that a leading one of said plurality of heating elements with respect to the scanning direction has a temperature higher than a temperature of any other one of said plurality of heating elements.

20. An image recording apparatus in accordance with claim 19, wherein said scanner is adapted to perform forward and reverse scans along the scanning direction, and wherein the temperature controller is adapted to control each of the plurality of heating elements during forward and reverse scans, so that for each of the forward and reverse scans, a corresponding leading one of said plurality of heating elements with respect to the scanning direction has a temperature higher than a temperature of any other one of said plurality of heating elements.

21. An image recording apparatus in accordance with claim 20, wherein the temperature controller is adapted to control said plurality of heating elements so that, for each of the forward and reverse scans, a temperature of each sequential one of said heating elements along the scanning direction progressively decreases from said corresponding leading one of said plurality of heating elements to a corresponding trailing one of said plurality of heating elements.

22. An image recording apparatus in accordance with claim 21, wherein the temperature controller is adapted to control a temperature of each of said plurality of heating elements so that the sequence of temperatures of the heating elements, relative to a direction of motion for each of the forward and reverse scans, is kept constant during each of the forward and reverse scans.

23. An image recording apparatus in accordance with claim 22, wherein the temperature controller is adapted to control the voltage applied to each heating element such that the sequence of temperatures of the heating elements is kept constant.

24. An image recording apparatus in accordance with claim 16, further comprising:

a rotating apparatus for rotating the thermal head; and a rotation controller for controlling a rotation of the thermal head based on a direction of motion;

wherein the scanner is adapted to perform forward scans and reverse scans relative to the scanning direction, and wherein a sequence of heating temperatures of the heating elements for each of the forward and reverse scans is kept constant, and wherein the thermal head is rotated 180 degrees between performing forward and reverse scans along the scanning direction.

25. An image recording apparatus in accordance with claim 16, further comprising a slow cooling member, provided between the first and second heaters, for gradually cooling the recording medium after heating.

26. An image recording apparatus in accordance with claim 25, further comprising a selecting mechanism for selectively introducing and withdrawing the slow cooling member from a position proximate to the recording medium.

27. An image recording apparatus for forming an image onto a thermally sensitive recording medium having a recording layer containing a liquid crystalline material of which a display color varies in response to a temperature of heat applied thereto, said image recording apparatus comprising:

a first heating device for heating the recording medium to a clearing temperature at which the liquid crystalline material exhibits an isotropic phase;

a second heating device for heating the recording medium that has been heated by the first heater;

a scanning device for controlling a position of application of said heating by said second heater on said recording medium; and a device for controlling a temperature of said heating on said recording medium, wherein the device for controlling the temperature is adapted to control a temperature of the second heating device in synchronism with the scanning device based on image data to be recorded onto the recording medium so that colors corresponding to the image data are written to the recording medium.

28. An image recording device in accordance with claim 27, wherein said second heating device is selected from the group consisting of a laser device and a thermal head.

29. An image recording device in accordance with claim 27, wherein said second heating device includes a plurality of laser devices, at least one of said plurality of laser devices being adapted for heating said recording medium to a temperature different than another one of said plurality of laser devices.

30. An image recording device in accordance with claim 29, wherein at least one of said plurality of laser devices is a laser diode.

31. An image recording device in accordance with claim 27, wherein said second heating device includes a plurality of heating elements, at least one of said plurality of heating elements being adapted for heating said recording medium to a temperature different than another one of said plurality of heating elements.

32. An image recording device in accordance with claim 27, wherein said scanning device is selected from the group consisting of an optical scanner and a mechanical scanner.

33. An image recording device in accordance with claim 32, further comprising a recording medium transporting mechanism for transporting said recording medium in a subscanning direction.

34. An image recording apparatus for forming an image onto a recording medium having a recording layer containing a liquid crystalline material of which a display color varies in response to a temperature of heat applied thereto and in which the display color is fixed by cooling, said image recording apparatus comprising:

a first section for heating the recording medium to a clearing temperature at which the liquid crystalline material exhibits an isotropic phase; and a second section for, after the heating of the recording medium by the first section, selectively managing temperature changes of portions of the recording medium to define display colors thereof, respectively, wherein different display colors respectively correspond to different temperature changes.

35. An image recording apparatus in accordance with claim 34, wherein the second section comprises a thermal head having a plurality of heating elements.

36. An image recording apparatus in accordance with claim 35, wherein the second section further comprises a scanning mechanism for moving the thermal head in a scanning direction.

37. An image recording apparatus in accordance with claim 36, wherein the second section further comprises a conveyance mechanism for moving the recording medium in a conveyance direction substantially perpendicular to the scanning direction.

38. An image recording apparatus in accordance with claim 37, wherein the plurality of heating elements are arranged to form a plurality of heating element arrays, wherein each of the plurality of heating element arrays is oriented substantially parallel to the conveyance direction, and wherein each of the plurality of heating element arrays is distanced from one another at prescribed intervals substantially parallel to the scanning direction.

39. An image recording apparatus in accordance with claim 38, wherein each of the plurality of heating element arrays is for heating the recording medium to a temperature which is different from temperatures of the other heating element arrays, each temperature corresponding to a display color of the portions of the recording medium.

40. An image recording apparatus in accordance with claim 39, wherein the second section further comprises a heater driver which controls the temperature of each of the plurality of heating element arrays such that a leading array of the plurality of heating element arrays with respect to the scanning direction has a temperature that is higher than a temperature of any other one of the plurality of heating element arrays.

41. An image recording apparatus in accordance with claim 40, wherein the scanning mechanism is adapted to move the thermal head forward and backward with respect to the scanning direction, and wherein the heater driver controls the temperature of each of the plurality of heating element arrays such that a leading array of the plurality of heating element arrays, with respect to the direction the thermal head is moving, has a temperature that is higher than a temperature of any other one of the plurality of heating element arrays.

42. An image recording apparatus in accordance with claim 41, wherein the heater driver controls the temperature of each of the plurality of heating element arrays such that a temperature of each sequential one of the heating element arrays from the leading array to a trailing array has a progressively lower temperature.

43. An image recording apparatus in accordance with claim 42, wherein the second section further comprises a heat reflector for deflecting heat from each of the plurality of heating elements onto the recording medium.

44. An image recording apparatus in accordance with claim 43, wherein the second section further comprises a heat reflector moving mechanism for moving the heat reflector.

45. An image recording apparatus in accordance with claim 44, wherein the heat reflector moving mechanism rotates the heat reflector so that heat deflected from the heat reflector linearly scans the recording medium in a scanning direction.

46. An image recording apparatus in accordance with claim 45, wherein the second section further comprises a conveying mechanism for conveying the recording medium in a conveyance direction substantially perpendicular to the scanning direction, wherein the heat reflector is a multifaceted heat reflector positioned such that as the multifaceted heat reflector rotates, each face of the multifaceted heat reflector sequentially scans heat received from the plurality of heating elements across the recording medium in the scanning direction as the recording medium is transported in the conveyance direction.

47. An image recording apparatus in accordance with claim 46, wherein the plurality of heating elements is a plurality of laser diodes and wherein the multifaceted heat reflector is a polygonal mirror.

48. An image recording apparatus in accordance with claim 38, wherein the second section further comprises:

a rotating mechanism for rotating the thermal head; and a rotating mechanism driver for controlling the rotating mechanism, wherein the scanning mechanism is adapted to move the thermal head in both a forward and a backward direction with respect to the scanning direction, and wherein the thermal head is rotated each time the scanning mechanism changes between moving the thermal head in the forward and the backward directions such that a leading heating element array with respect to one of the forward and backward directions will be reoriented to remain the leading heating element array with respect to the other of the forward and backward directions.

49. An image recording apparatus in accordance with claim 39, wherein the heater driver controls the voltage applied to each of the plurality of heating elements, thereby controlling the temperature of each of the plurality of heating elements.

50. An image recording apparatus in accordance with claim 34, wherein the second section includes a plurality of heating elements, each heating element adapted for selectively heating the portions of the recording medium.

51. An image recording apparatus in accordance with claim 50, wherein the plurality of heating elements is a plurality of laser diodes.

52. An image recording apparatus in accordance with claim 34, further comprising:

a third section, provided between the first and second sections, for cooling the recording medium heated by the first section.

53. An image recording apparatus in accordance with claim 34, wherein the second section comprises a cooling member for rapidly cooling the recording median, the rapid cooling of each portion of the recording medium forms a part of the temperature change of the respective portion.

54. An image recording apparatus in accordance with claim 34, wherein the liquid crystalline material exhibits a liquid crystalline phase in a temperature range lower than the clearing temperature and higher than a room temperature, and wherein each of the temperature changes includes a temperature history in the temperature range.

* * * * *